US009583039B2

(12) United States Patent
Lee

(10) Patent No.: US 9,583,039 B2
(45) Date of Patent: Feb. 28, 2017

(54) METHOD OF DIGITALLY DRIVING ORGANIC LIGHT-EMITTING DIODE (OLED) DISPLAY

(71) Applicant: Samsung Display Co., Ltd., Yongin, Gyeonggi-do (KR)

(72) Inventor: Jae-Hoon Lee, Seoul (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 26 days.

(21) Appl. No.: 14/573,504

(22) Filed: Dec. 17, 2014

(65) Prior Publication Data

US 2015/0364080 A1 Dec. 17, 2015

(30) Foreign Application Priority Data

Jun. 12, 2014 (KR) ..... 10-2014-0071710

(51) Int. Cl.
*G09G 3/32* (2016.01)
*G09G 3/20* (2006.01)

(52) U.S. Cl.
CPC ..... *G09G 3/3208* (2013.01); *G09G 3/2022* (2013.01); *G09G 2310/0213* (2013.01); *G09G 2330/021* (2013.01)

(58) Field of Classification Search
CPC ..... G09G 3/3216; G09G 2330/02; G09G 2330/021; G09G 2310/0213; G09G 3/2022; G06F 1/3203–1/3296
USPC ..... 345/211
See application file for complete search history.

(56) References Cited

U.S. PATENT DOCUMENTS

2003/0146910 A1 8/2003 Tokunaga
2005/0128175 A1* 6/2005 Hong ..... G09G 3/3688 345/100
2008/0219047 A1* 9/2008 Yu ..... G11C 7/1006 365/163
2010/0079669 A1 4/2010 Hattori et al.
2010/0214197 A1 8/2010 Matsunaga et al.
2013/0314456 A1* 11/2013 Kim ..... G09G 3/2029 345/691
2014/0152716 A1* 6/2014 Lee ..... G09G 3/2022 345/691

FOREIGN PATENT DOCUMENTS

JP 2003-228319 A 8/2003
JP 2010-078987 A 4/2010
KR 10-2009-0021582 A 3/2009

* cited by examiner

*Primary Examiner* — Andrew Sasinowski
*Assistant Examiner* — Chineyere Wills-Burns
(74) *Attorney, Agent, or Firm* — Knobbe Martens Olson & Bear LLP

(57) ABSTRACT

A method of digitally driving an organic light-emitting diode (OLED) display is disclosed. In one aspect, the method includes calculating a first power consumption of a data driver for a first frame while first data bits are input to the data driver. The first data bits are input to the data driver in a data bit input order. The method also includes modifying the data bit input order and inputting second data bits to the data driver for a second frame in the modified data bit input order when the first power consumption is greater than a threshold power consumption.

20 Claims, 30 Drawing Sheets

METHOD OF DIGITALLY DRIVING ORGANIC LIGHT-EMITTING DIODE (OLED) DISPLAY

INCORPORATION BY REFERENCE TO ANY PRIORITY APPLICATIONS

This application claims priority under 35 USC §119 to Korean Patent Applications No. 10-2014-0071710, filed on Jun. 12, 2014 in the Korean Intellectual Property Office (KIPO), the contents of which are incorporated herein in its entirety by reference.

BACKGROUND

Field

The described technology generally relates to a method of digitally driving an OLED display.

Description of the Related Technology

Recently, organic light-emitting diode (OLED) displays are widely used as flat panel displays included in electric devices. Such electric devices are getting smaller and consuming less power. OLED displays typically operate by displaying a specific gray level using a voltage stored in a storage capacitor of each pixel (i.e., using an analog driving technique for an OLED display). However, such analog driving techniques may not accurately display a desired gray level since individual voltages (i.e., analog values) are stored in the storage capacitor of each pixel.

SUMMARY OF CERTAIN INVENTIVE ASPECTS

One inventive aspect is a method of digitally driving an organic light-emitting diode (OLED) display with a low power consumption by modifying input order of data bits of sub-frames. The data bits are inputted to a data driving circuit as a data signal.

Another aspect is a method of digitally driving an (OLED) display, which displays a frame by displaying a plurality of sub-frames when the frame is divided into the plurality of the sub-frames, includes a calculating a first power consumption of a data driving circuit while first data bits of first sub-frames are inputted to the data driving circuit as a data signal according to a data bit input order, and a modifying the data bit input order and inputting second data bits of second sub-frames to the data driving circuit as the data signal according to the modified data bit input order when the first power consumption of the data driving circuit is bigger than a threshold power consumption.

In example embodiments, the method may further include an inputting the second data bits to the data driving circuit as the data signal according to the data bit input order when the first power consumption of the data driving circuit is equal to or smaller than the threshold power consumption.

In an example embodiment, the OLED display may include a plurality of pixels and a plurality of scan lines, the plurality of the pixels may be connected to the plurality of the scan lines respectively, and the frame includes a plurality of unit display periods and the number of the plurality of the scan lines and the number of the plurality of the unit display periods may be the same.

In an example embodiment, the first sub-frames may be third sub-frames of first pixels, the third sub-frames starting display in a first unit display period.

In an example embodiment, the second sub-frames may be fourth sub-frames of second pixels, the fourth sub-frames starting display in a second unit display period.

In an example embodiment, the first or second sub-frames may be fifth sub-frames of third pixels, the fifth sub-frames starting display in a pre-determined period.

In an example embodiment, the data signal may be a bit signal, the first data bits may be sequentially inputted to the data driving circuit as the data signal, and the second data bits may be sequentially inputted to the data driving circuit as the data signal.

In an example embodiment, the method may further include a calculating a second power consumption of the data driving circuit while the second data bits are inputted to the data driving circuit as the data signal, and remodifying the data bit input order until the second power consumption of the data driving circuit is equal to smaller than the threshold power consumption, and an inputting third data bits of third sub-frames to the data driving circuit as the data signal according to the remodified data bit input order.

In an example embodiment, modifying the data bit input order and inputting the second data bits of the second sub-frames to the data driving circuit as the data signal according to the modified data bit input order may include an exchanging input orders of data bits of the plurality of the sub-frames on the data bit input order.

In an example embodiment, modifying the data bit input order and inputting the second data bits of the second sub-frames to the data driving circuit as the data signal according to the modified data bit input order may include a modifying the data bit input order that logical value transitions of the data signal occur N times (N is a natural number) while the first data bits are inputted to the data driving circuit as the data signal.

In an example embodiment, modifying the data bit input order that the logical value transitions of the data signal occur N times while the first data bits are inputted to the data driving circuit as the data signal may include a modifying the data bit input order that an input order of a least significant bit of the first data bits is first on the data bit input order when the least significant bit has logical value 1.

In an example embodiment, modifying the data bit input order that the logical value transitions of the data signal occur N times while the first data bits are inputted to the data driving circuit as the data signal may further include a modifying the data bit input order that an input order of a data bit, which has logical value 1 and is included in the first data bits, is faster than an input order of another data bit, which has logical value 0 and included in the first data bits, on the data bit input order.

In an example embodiment, modifying the data bit input order that the logical value transitions of the data signal occur N times while the first data bits are inputted to the data driving circuit as the data signal may include a modifying the data bit input order that an input order of a least significant bit of the first data bits is first on the data bit input order when the least significant bit has logical value 0.

In an example embodiment, modifying the data bit input order that the logical value transitions of the data signal occur N times while the first data bits are inputted to the data driving circuit as the data signal may further include a modifying the data bit input order that an input order of a data bit, which has logical value 0 and is included in the first data bits, is faster than an input order of another data bit, which has logical value 1 and is included in the first data bits, on the data bit input order.

In an example embodiment, a gray level of a pixel included in the OLED display may be implemented based on the sum of light emitting periods of the plurality of the sub-frames included in the frame.

In an example embodiment, a sub-frame having a longest light emitting period among the plurality of the sub-frames may correspond to a most significant bit of the first data bits, and a sub-frame having a shortest emitting period among the plurality of the sub-frames may correspond to a least significant bit of the first data bits.

In an example embodiment, calculating the first power consumption of the data driving circuit may include a calculating the first power consumption of the data driving circuit based on a current of the data driving circuit.

In an example embodiment, calculating the first power consumption of the data driving circuit may include a calculating the first power consumption of the data driving circuit based on the number of logical value transitions of the data signal.

In an example embodiment, the OLED display may include the data driving circuit and pixels, and the data driving circuit may provide signals, generated by driving the first data bits or the second data bits, to the pixels.

Another aspect is a method of digitally driving an organic light-emitting diode (OLED) display, which displays a frame by displaying a plurality of sub-frames, the frame being divided into the sub-frames, the method comprising calculating a first power consumption of a data driver while first data bits of first sub-frames are input to the data driver, wherein the first data bits are input to the data driver as a data signal in a data bit input order; modifying the data bit input order; and inputting second data bits of second sub-frames to the data driver as the data signal in the modified data bit input order when the first power consumption is greater than a threshold power consumption.

In example embodiments, the method can further comprise inputting the second data bits to the data driver as the data signal in the data bit input order when the first power consumption is substantially equal to or less than the threshold power consumption. The OLED display can include a plurality of pixels and a plurality of scan lines, the pixels can be connected to the scan lines and the frame can include a plurality of display periods and the number of the scan lines and the number of the display periods are equal. The first sub-frames can be sub-frames of first pixels starting display in a first display period. The second sub-frames can be sub-frames of second pixels starting display in a second display period. The first and second data bits can be respectively input to the data driver as the data signal, which is a bit signal.

In example embodiments, the method can further include calculating a second power consumption of the data driver while the second data bits are input to the data driver as the data signal, remodifying the data bit input order until the second power consumption is substantially equal to or less than the threshold power consumption; and inputting third data bits of third sub-frames to the data driver as the data signal in the remodified data bit input order. The modifying can comprise exchanging the input orders in the data bit input order. The modifying can comprise reducing the number of logical value transitions of the data signal while the first data bits are input to the data driver as the data signal. The modifying can further comprise placing a least significant bit of the first data bits as first in the data bit input order when the least significant bit has logical value 1. The modifying can further comprise placing data bits of the first data bits which have logical value 1 earlier in the data bit input order than data bits of the first data bits which have logical value 0. The modifying can further comprise placing a least significant bit of the first data bits as first in the data bit input order when the least significant bit has logical value 0. The modifying can further comprise placing data bits of the first data bits which have logical value 0 earlier in the data bit input order than data bits of the first data bits which have logical value 1.

In example embodiments, a gray level of a pixel included in the OLED display can be substantially proportional to the sum of light emitting periods applied to the pixel. A sub-frame having a longest light emitting period among the sub-frames can correspond to a most significant bit of the first data bits and a sub-frame having a shortest emitting period among the sub-frames can correspond to a least significant bit of the first data bits. The calculating can be based on a current consumed by the data driver. The calculating can be based on the number of logical value transitions of the data signal while the first data bits are input to the data driver as the data signal. The OLED display can include a plurality of pixels and the method can further comprises providing signals, generated based on the first data bits or the second data bits, to the pixels.

Another aspect is an organic light-emitting diode (OLED) display, comprising a plurality of OLEDs; a data driver connected to the OLEDs; a power measurement unit configured to measure the power consumed by the data driver; and a timing controller configured to: supply a plurality of first data bits to the data driver for each OLED in a first sub-frame, wherein the first data bits are supplied to the data driver in a first order; receive a power consumption level from the power measurement unit indicating the power consumption of the data driver in the first sub-frame; modify the first order to a second order when the power consumption is greater than a threshold power consumption; and supply a plurality of second data bits to the data driver for each OLED in a second sub-frame, wherein the second data bits are supplied in the second order.

In example embodiments, the OLED display can further comprise further comprising a plurality of scan lines connected to the pixels, wherein each frame is divided into a plurality of sub-frames and a plurality of display periods.

According to at least one embodiment, a method of digitally driving an OLED display may decrease power consumption of the data driving circuit or the OLED display including the data driving circuit by minimizing the number of logical value transitions of the data signal by modifying the input order of data bits of a data signal.

DETAILED DESCRIPTION OF CERTAIN INVENTIVE EMBODIMENTS

Figure 1:
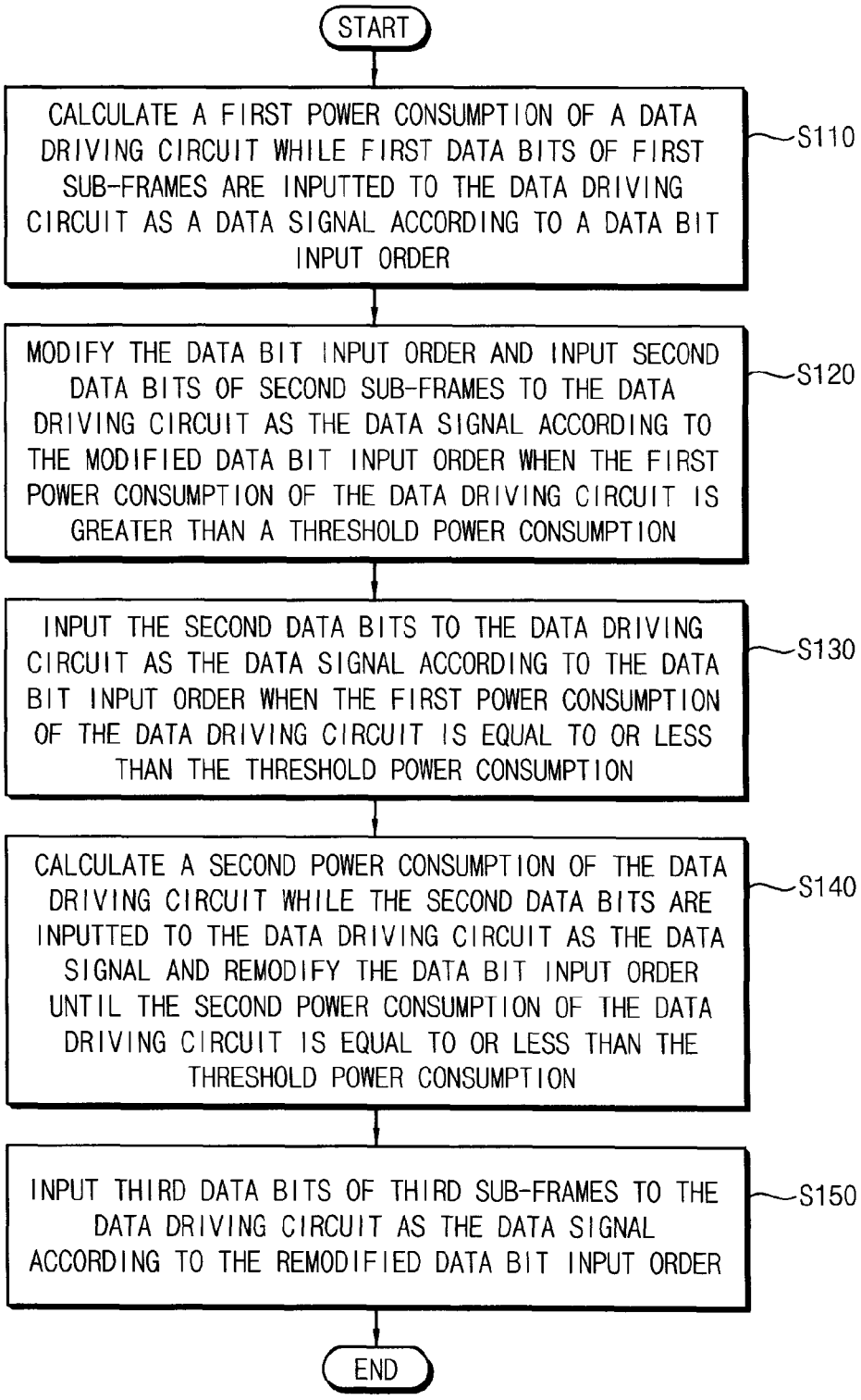
FIG. 1 is a flow chart illustrating a method of digitally driving an OLED display according to an example embodiment.

To overcome the problems associated with analog driving, digital driving techniques for OLED displays have been developed. Such techniques display a frame by dividing the frame into a plurality of sub-frames and displaying each of the sub-frames. In an example embodiment, the digital driving technique sets the light emitting periods of the sub-frames to be different from each other by, for example, a factor of 2. In another example embodiment, the light emitting periods of the sub-frames are set according to a ratio which is pre-determined by a user. The digital driving technique can emit light with a luminance corresponding to a specific gray level using a sum of the emission periods of the sub-frames. Further, as the number of pixels of an OLED display panel employing digital driving increases, the power consumption of the display also increases.

Various example embodiments will be described more fully hereinafter with reference to the accompanying drawings, in which some example embodiments are shown. The described technology may, however, be embodied in many different forms and should not be construed as limited to the example embodiments set forth herein. Rather, these example embodiments are provided so that this disclosure will be thorough and complete, and will fully convey the scope of the described technology to those skilled in the art. In the drawings, the sizes and relative sizes of layers and regions may be exaggerated for the sake of clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the described technology. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the described technology. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a flow chart illustrating a method of digitally driving an OLED display according to an example embodiment.

Referring to FIG. 1, a method of a digitally driving an OLED display, which displays a frame by dividing the frame into a plurality of sub-frames and displaying the sub-frames, includes calculating a first power consumption of a data driving circuit while first data bits of first sub-frames are inputted to the data driving circuit as a data signal according to a data bit input order (S110). The method further includes modifying the data bit input order and inputting second data bits of second sub-frames to the data driving circuit as the data signal according to the modified data bit input order when the first power consumption of the data driving circuit is greater than a threshold power consumption (S120).

The method further includes inputting the second data bits to the data driving circuit as the data signal according to the data bit input order when the first power consumption of the data driving circuit is equal to or less than the threshold power consumption (S130).

The method further includes calculating a second power consumption of the data driving circuit while the second data bits are inputted to the data driving circuit as the data signal and remodifying the data bit input order until the second power consumption of the data driving circuit is equal to or less than the threshold power consumption (S140) and inputting third data bits of third sub-frames to the data driving circuit as the data signal according to the remodified data bit input order (S150).

The calculating of the first power consumption of the data driving circuit (S110) will be described with the reference to FIG. 2. The modifying of the data bit input order and inputting of the second data bits of the second sub-frames to the data driving circuit as the data signal according to the modified data bit input order (S120) will be described with the reference to FIG. 3.

The inputting of the second data bits to the data driving circuit as the data signal according to the data bit input order (S130), the calculating of the second power consumption of the data driving circuit (S140), and the inputting of the third data bits of third sub-frames to the data driving circuit as the data signal according to the remodified data bit input order (S150) will be described with reference to FIGS. 2 and 3.

Figure 2:
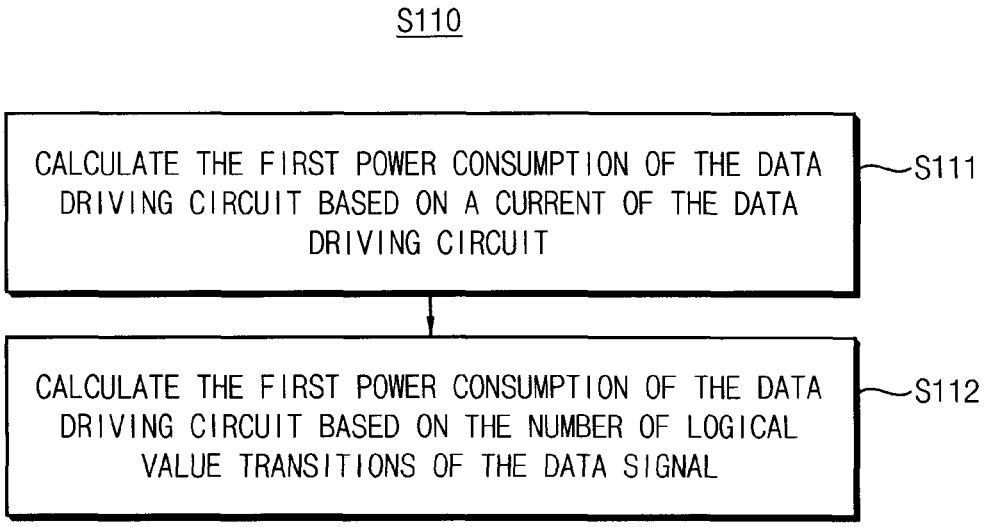
FIG. 2 is a flow chart illustrating calculating the first power consumption of the data driving circuit included in the flow chart of FIG. 1.

FIG. 2 is a flow chart illustrating calculating the first power consumption of the data driving circuit included in the flow chart of FIG. 1.

Referring to FIG. 2, the calculating of the first power consumption of the data driving circuit (S110) includes calculating the first power consumption of the data driving circuit based on a current of the data driving circuit (S111). The calculating of the first power consumption of the data driving circuit based on the current of the data driving circuit (S111) will be described with the references to FIGS. 6 and 32.

The calculating of the first power consumption of the data driving circuit (S110) further includes calculating the first power consumption of the data driving circuit based on the number of logical value transitions of the data signal (S112). The calculating of the first power consumption of the data driving circuit based on the number of the logical value transitions of the data signal (S112) will be described with FIGS. 6 and 32.

Figure 3:
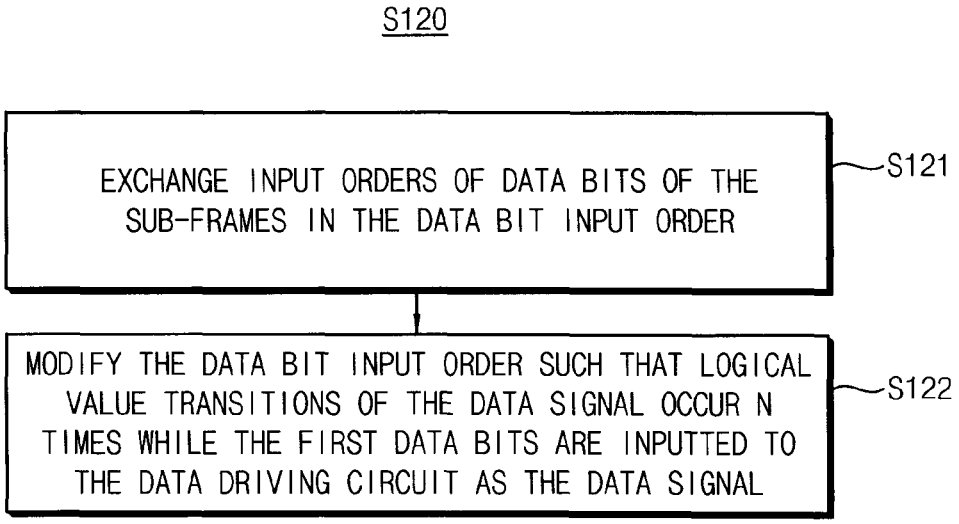
FIG. 3 is a flow chart illustrating modifying the data bit input order and inputting the second data bits of the second sub-frames to the data driving circuit as the data signal according to the modified data bit input order included in the flow chart of FIG. 1.

FIG. 3 is a flow chart illustrating the modifying of the data bit input order and the inputting of the second data bits of the second sub-frames to the data driving circuit as the data signal according to the modified data bit input order included in the flow chart of FIG. 1.

Referring to FIG. 3, the modifying of the data bit input order and inputting the second data bits of the second sub-frames to the data driving circuit as the data signal according to the modified data bit input order (S120) includes exchanging the input orders of data bits of the sub-frames in the data bit input order (S121). The exchanging of the input orders of the data bits of the sub-frames in the data bit input order (S121) will be described with reference to FIGS. 30 and 31.

The modifying of the data bit input order and inputting the second data bits of the second sub-frames to the data driving circuit as the data signal according to the modified data bit input order (S120) further includes modifying the data bit input order such that logical value transitions of the data signal occur N times (where N is a natural number) while the first data bits are inputted to the data driving circuit as the data signal (S122). The modifying of the data bit input order such that the logical value transitions of the data signal occur N times while the first data bits are inputted to the data driving circuit as the data signal (S122) will be described with reference to FIGS. 9 through 29.

The exchanging of the input orders of the data bits of the sub-frames on the data bit input order (S121) and the modifying of the data bit input order such that the logical value transitions of the data signal occur N times while the first data bits are inputted to the data driving circuit as the data signal (S 122) can be selectively executed.

Figure 4:
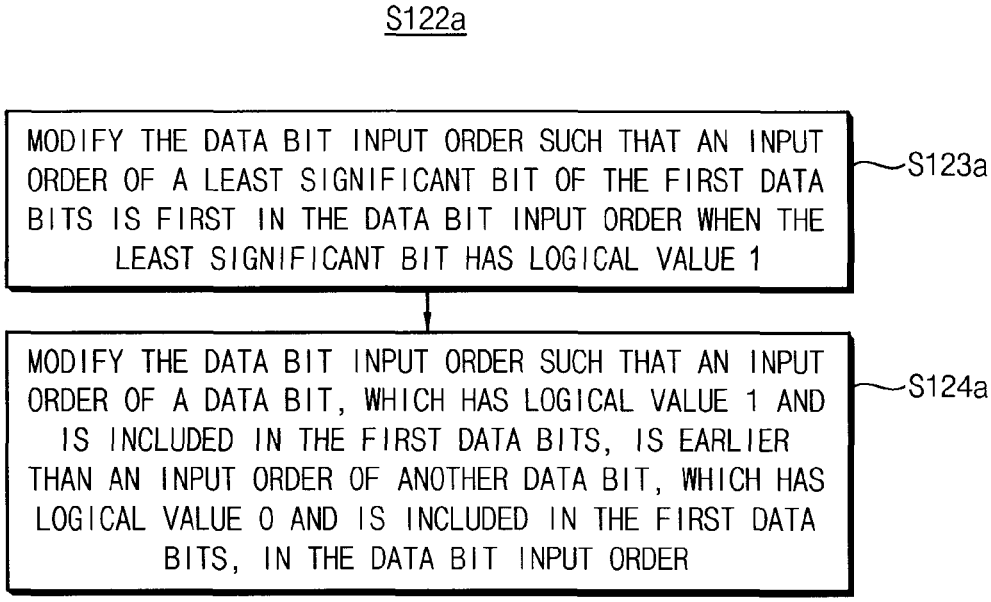
FIGS. 4 and 5 are flow charts illustrating example embodiments of modifying the data bit input order that the logical value transitions of the data signal occur N times while the first data bits are inputted to the data driving circuit as the data signal included in the flow chart of FIG. 3.
Figure 5:
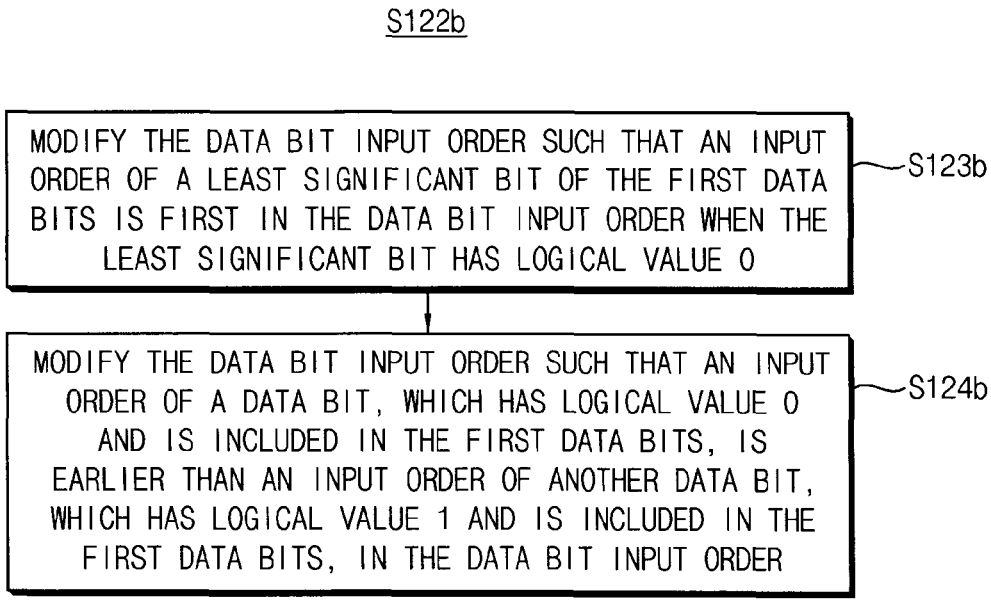

FIGS. 4 and 5 are flow charts illustrating example embodiments of the modifying of the data bit input order such that the logical value transitions of the data signal occur N times while the first data bits are inputted to the data driving circuit as the data signal included in the flow chart of FIG. 3.

Referring to the FIG. 4 embodiment, in an example embodiment, the modifying of the data bit input order such that the logical value transitions of the data signal occur N times while the first data bits are inputted to the data driving circuit as the data signal (S122*a*) includes modifying the data bit input order such that an input order of a least significant bit of the first data bits is first in the data bit input order when the least significant bit has logical value 1 (S123*a*). In this embodiment, the modifying (S122*a*) further includes modifying the data bit input order such that an input order of a data bit, which has logical value 1 and is included in the first data bits, is earlier than an input order of another data bit, which has logical value 0 and is included in the first data bits, in the data bit input order (S124*a*).

The modifying of the data bit input order such that the input order of the least significant bit of the first data bits is first in the data bit input order when the least significant bit has logical value 1 (S123*a*) and the modifying of the data bit input order such that the input order of the data bit, which has logical value 1 and is included in the first data bits, is earlier than the input order of the other data bit, which has logical value 0 and is included in the first data bits, in the data bit input order (S124*a*) will be described with reference to FIGS. 20 through 29.

Referring to the embodiment of FIG. 5, in another example embodiment, the modifying of the data bit input order such that the logical value transitions of the data signal occur N times while the first data bits are inputted to the data driving circuit as the data signal (S122*b*) includes modifying the data bit input order such that an input order of a least significant bit of the first data bits is first in the data bit input order when the least significant bit has logical value 0 (S123*b*). This embodiment further includes modifying the data bit input order such that an input order of a data bit, which has logical value 0 and is included in the first data bits, is earlier than an input order of another data bit, which has logical value 1 and is included in the first data bits, in the data bit input order (S124*b*).

The modifying of the data bit input order such that the input order of the least significant bit of the first data bits is first in the data bit input order when the least significant bit has logical value 0 (S123*b*) and the modifying of the data bit input order such that the input order of the data bit, which has logical value 0 and is included in the first data bits, is earlier than the input order of the other data bit, which has logical value 1 and is included in the first data bits, in the data bit input order (S124*b*) will be described with reference to FIGS. 10 through 19.

Figure 6:
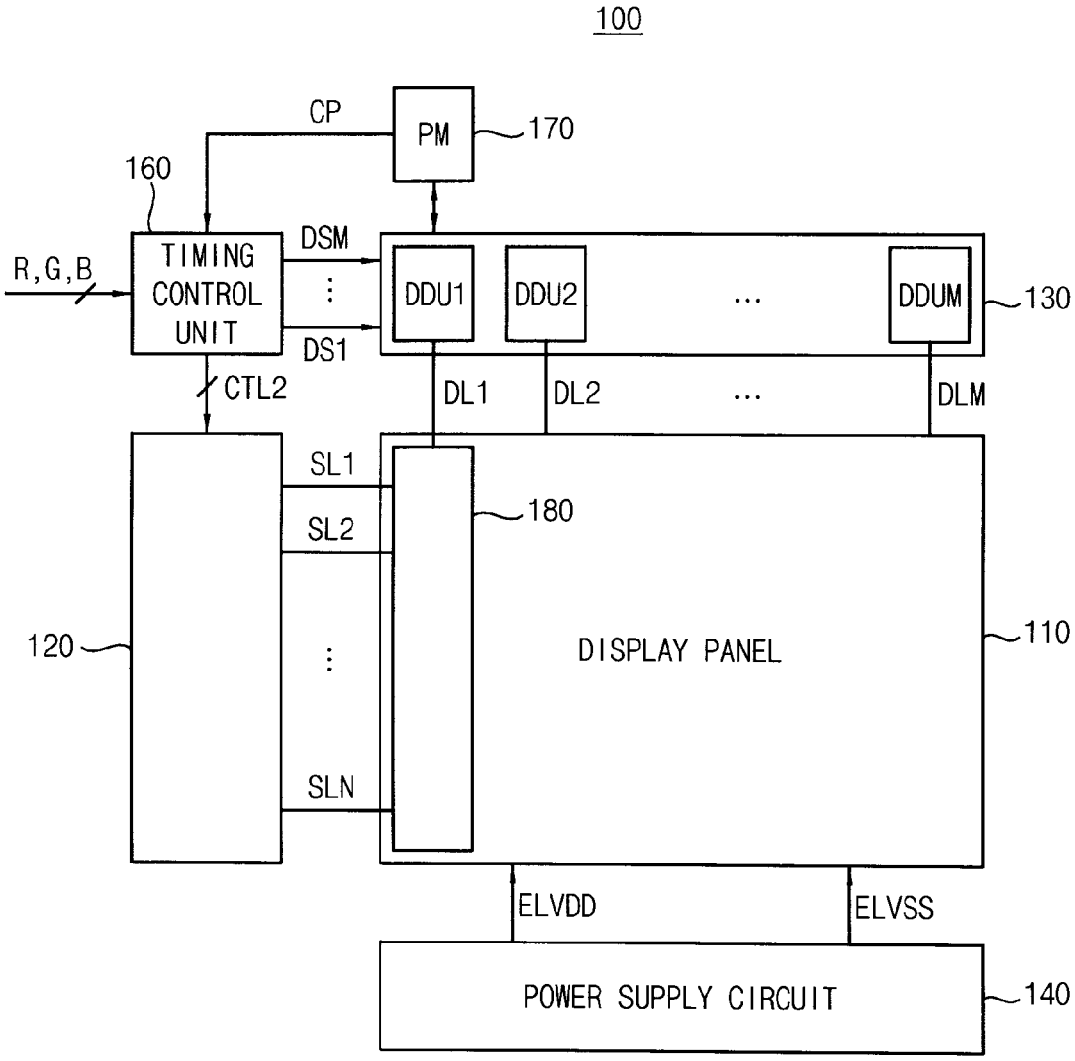
FIG. 6 is a block diagram illustrating an OLED display according to an example embodiment.

FIG. 6 is a block diagram illustrating an OLED display according to an example embodiment.

Referring to FIG. 6, the OLED display 100 includes a display panel 110, a scan driving circuit or scan driver 120, a data driving circuit or data driver 130, a power supply circuit or power supply 140, a power measurement unit 170, and a timing control circuit or timing controller 160. The display panel 110 includes first pixels 180 and second pixels through (M)-th pixels. The data driving circuit 130 includes a first data driving unit DDU1, a second data driving unit DDU2 through an (M)-th data driving unit DDUM.

The display panel 110 is connected to the scan driving circuit 120 through a plurality of scan lines SL1 through SLN. The display panel 110 is connected to the data driving circuit 130 through a plurality of data lines DL1 through DLM. In detail, the first pixels 180 are connected to the first data driving unit DDU1 through the first data line DL1. The second pixels are connected to the second data driving unit DDU2 through the second data line DL2. Similarly, the (M)-th pixels are connected to the (M)-th data driving unit DDUM through the (M)-th data line DLM.

The first pixels 180 include N pixels which are respectively connected to the scan lines SL1 through SLN. The second pixels also include N pixels which are respectively connected to the scan lines SL1 through SLN. Similarly, the (M)-th pixels include N pixels which are respectively connected to the scan lines SL1 through SLN. Accordingly, the display panel 110 includes M*N pixels. The first pixels 180 will be described with reference to FIG. 7.

The timing control circuit 160 generates a scan driving circuit control signal CTL2 controlling the scan driving circuit 120 based on the input image pixel data R, G, and B. The timing control circuit 160 also generates first through (M)-th data bits according to the data bit input order based on the input image pixel data R, G, and B. The timing control circuit 160 respectively provides the first through (M)-th data bits to the data driving circuit 130 as the first through (M)-th data signals DS1 through DSM.

The scan driving circuit 120 provides scan signals based on the scan driving circuit control signal CTL2 to the display panel 110 through the scan lines SL1 through SLN.

The data driving circuit 130 provides first through (M)-th pixel data signals based on the first through (M)-th data signals DS1 through DSM to pixels included in the display panel 110 through the data lines DL1 through DLM. Each of the first through (M)-th data signals DS1 through DSM is a bit signal.

In an example embodiment, the power measurement unit 170 measures the current of the data driving circuit 130 and calculates the power consumption CP of the data driving circuit 130 based on the measured current. In another example embodiment, the power measurement unit 170 calculates the power consumption CP of the data driving circuit 130 based on the number of logical value transitions of the first through (M)-th data signals DS1 through DSM.

The timing control circuit 160 modifies the data bit input order based on the power consumption CP of the data driving circuit 130. The timing control circuit 160 generates first through (M)-th data bits according to the modified data bit input order and provides the first through (M)-th data bits as the first through (M)-th data signals DS1 through DSM to the data driving circuit 130. The method of modifying the data bit input order will be described in detail with reference to FIGS. 9 through 31.

The power supply circuit 140 provides the high power supply voltage ELVDD and the low power supply voltage ELVSS to the display panel 110.

Figure 7:
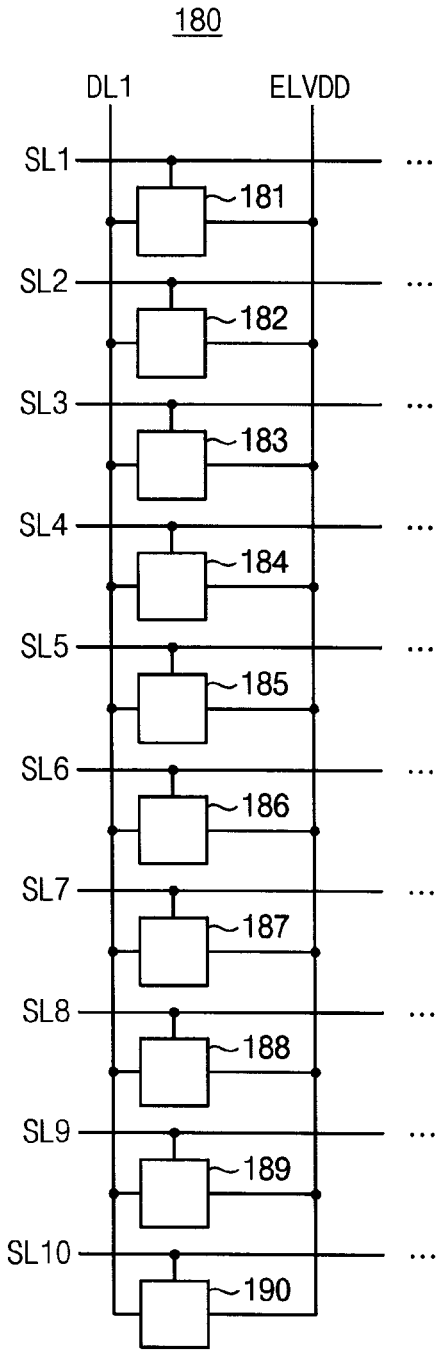
FIG. 7 is a block diagram illustrating first pixels included in the OLED display of FIG. 6.

FIG. 7 is a block diagram illustrating first pixels included in the OLED display of FIG. 6.

Referring to FIG. 7, the first pixels 181 through 190 are connected to the first data line DL1 when the OLED display 100 of FIG. 6 includes, for example, first through tenth scan lines SL1 through SL10. The first pixels 181 through 190 are connected to the high power supply voltage ELVDD. The first to tenth pixels 181 to 190 are respectively connected to the first to tenth scan lines SL1 to SL10.

Figure 8:
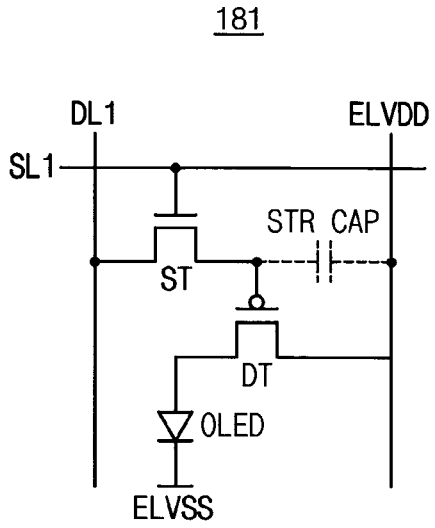
FIG. 8 is a block diagram illustrating a first pixel included the first pixels of FIG. 7.

FIG. 8 is a block diagram illustrating an exemplary first pixel included the first pixels of FIG. 7.

Referring to FIG. 8, the first pixel 181 includes a switching transistor ST, a driving transistor DT, an organic light-emitting diode (OLED), and a storage capacitor STR CAP. A source terminal of the switching transistor ST is electrically connected to the first data line DL1. A gate terminal of the switching transistor ST is electrically connected to the first scan line SL1. A drain terminal of the switching transistor ST is electrically connected to a terminal of the storage capacitor STR CAP and a gate terminal of the driving transistor DT. The other terminal of the storage capacitor STR CAP is electrically connected to the high power supply voltage ELVDD. A source terminal of the driving transistor DT is electrically connected to the high power supply voltage ELVDD. A drain terminal of the driving transistor DT is electrically connected to a terminal of the OLED. The other terminal of the OLED is electrically connected to the low power supply voltage ELVSS. The OLED emits light when the switching transistor ST and the driving transistor DT are turned-on based on a signal received from the first data line DL1 and a signal receive from the first scan cline SL1. Accordingly, a voltage which is greater than a threshold voltage is applied to the terminals of the OLED.

Figure 9:
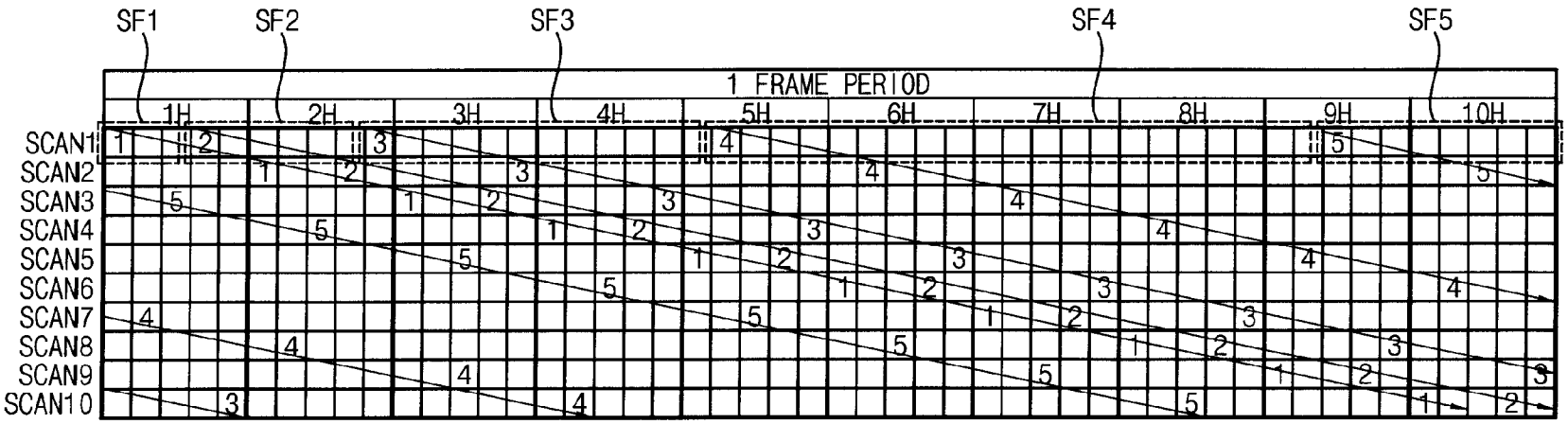
FIG. 9 is a diagram illustrating a data bit input order of data bits of sub-frames to the first data driving unit included in the OLED display of FIG. 6.

FIG. 9 is a diagram illustrating a data bit input order of data bits of sub-frames applied to the first data driving unit included in the OLED display of FIG. 6. The second through (M)-th data driving units DDU2 through DDUM included in the OLED display 100 of FIG. 6 may have the same or similar structure as the first data driving unit DDU1. The operation of the second through (M)-th data driving units DDU2 through DDUM can be understood based on operation of the first data driving unit DDU1.

Referring to FIG. 9, in general, the number of first through (M)-th display periods included in a frame 1 FRAME PERIOD is the same as the number M of the first through (M)-th scan lines SL1 through SLM included in the OLED display 100. FIG. 9 illustrates an embodiment where M is 10 and the frame 1 FRAME PERIOD includes five sub-frames. In FIG. 9, the frame 1 FRAME PERIOD includes first through tenth display periods 1H through 10H. In the FIG. 9 embodiment, each of the first through tenth display periods 1H through 10H includes five sub display periods.

The gray level of the first pixel 181 is implemented based on the sum of the light emitting periods of the sub-frames SF1, SF2, SF3, SF4, and SF5 of the first pixel 181. The gray level of the second through tenth pixels 182 through 190 can be understood based on the gray level of the first pixel 181.

In an example embodiment, the fourth sub-frame SF4 having a longest light emitting period among the sub-frames of the first pixel 181 corresponds to a most significant bit of the first data bits of the flow chart of FIG. 1 and the first sub-frame SF1 having a shortest emitting period among the sub-frames of the first pixel 181 corresponds to a least significant bit of the first data bits of the flow chart of FIG. 1

In another example embodiment, light emitting periods of the sub-frames corresponding to the first data bits of the flow chart of FIG. 1 can be determined arbitrarily. In FIG. 9, the first sub-frame SF1 of the first pixel 181 can include 1 sub display period as a data input period and 2 sub display periods as a light emitting period and the second sub-frame SF2 of the first pixel 181 can include 1 sub display period as a data input period and 5 sub display periods as a light emitting periods. Similarly, the third sub-frame SF3 of the first pixel 181 can include 1 sub display period as data input period and 11 sub display periods as a light emitting period, the fourth sub-frame SF4 of the first pixel 181 can include 1 sub display period as a data input period and 20 sub display periods as a light emitting periods, and the fifth sub-frame SF5 of the first pixel 181 can include 1 sub display periods as data input periods and 7 sub display periods as a light emitting period.

Sub-frames included in the other pixels 182 through 190 can be understood based on the sub-frames included in the first pixel 181.

In a first example embodiment, the first or second sub-frame of the flow chart of FIG. 1 are referred to as third sub-frames of the pixels and the third sub-frames initiate the display in one of the first through tenth display periods 1H through 10H.

In a second example embodiment, the first or second sub-frame of the flow chart of FIG. 1 are referred to as fourth sub-frames of the pixels and the fourth sub-frames initiate the display in the first through tenth display periods 1H through 10H.

In a third example embodiment, the first or second sub-frames of the flow chart of FIG. 1 are referred to as fifth sub-frames of pixels and the fifth sub-frames initiate the display at a pre-determined time.

In the first example embodiment, the first sub-frames of the flow chart of FIG. 1 include the first sub-frame SF1 of the first pixel 181 since the first sub-frame SF1 can initiate the display in the first display period 1H. The first sub-frames of the flow chart of FIG. 1 include the second sub-frame SF2 of the first pixel 181 since the second sub-frame SF2 of the first pixel 181 can initiate the display in the first display period 1H. The first sub-frames of the flow chart of FIG. 1 can include the fifth sub-frame SF5 of the third pixel 183 since the fifth sub-frame SF5 of the third pixel 183 can initiate the display in the first display period 1H. The first sub-frames of the flow chart of FIG. 1 can include the fourth sub-frame SF4 of the seventh pixel 187 since the fourth sub-frame SF4 of the seventh pixel 187 can initiate the display in the first display period 1H. The first sub-frames of the flow chart of FIG. 1 can include the third sub-frame SF3 of the tenth pixel 190 since the third sub-frame SF3 of the tenth pixel 190 can initiate the display in the first display period 1H.

In addition, the second sub-frames of the flow chart of FIG. 1 can include the third sub-frame SF3 of the first pixel 181 since the third sub-frame SF3 of the first pixel 181 can initiate the display in the second display period 2H. The second sub-frames of the flow chart of FIG. 1 can include the first sub-frame SF1 of the second pixel 182 since the first sub-frame SF1 of the second pixel 182 can initiate the display in the second display period 2H. The second sub-frames of the flow chart of FIG. 1 can include the second sub-frame SF2 of the second pixel 182 since the second sub-frame SF2 of the second pixel 182 can initiate the display in the second display period 2H. The second sub-frames of the flow chart of FIG. 1 can include the fifth sub-frame SF5 of the fourth pixel 184 since the fifth sub-frame SF5 of the fourth pixel 184 can initiate the display in the second display period 2H. The second sub-frames of the flow chart of FIG. 1 can include the fourth sub-frame SF4 of the eighth pixel 188 since the fourth sub-frame SF4 of the eighth pixel 188 can initiate the display in the second display period 2H.

FIGS. 10 through 14 are timing diagrams illustrating a method of inputting data bits of sub-frames of the first pixels of FIG. 7 to the first data driving unit included in the OLED display of FIG. 6 according to the data bit input order.

Figure 10:
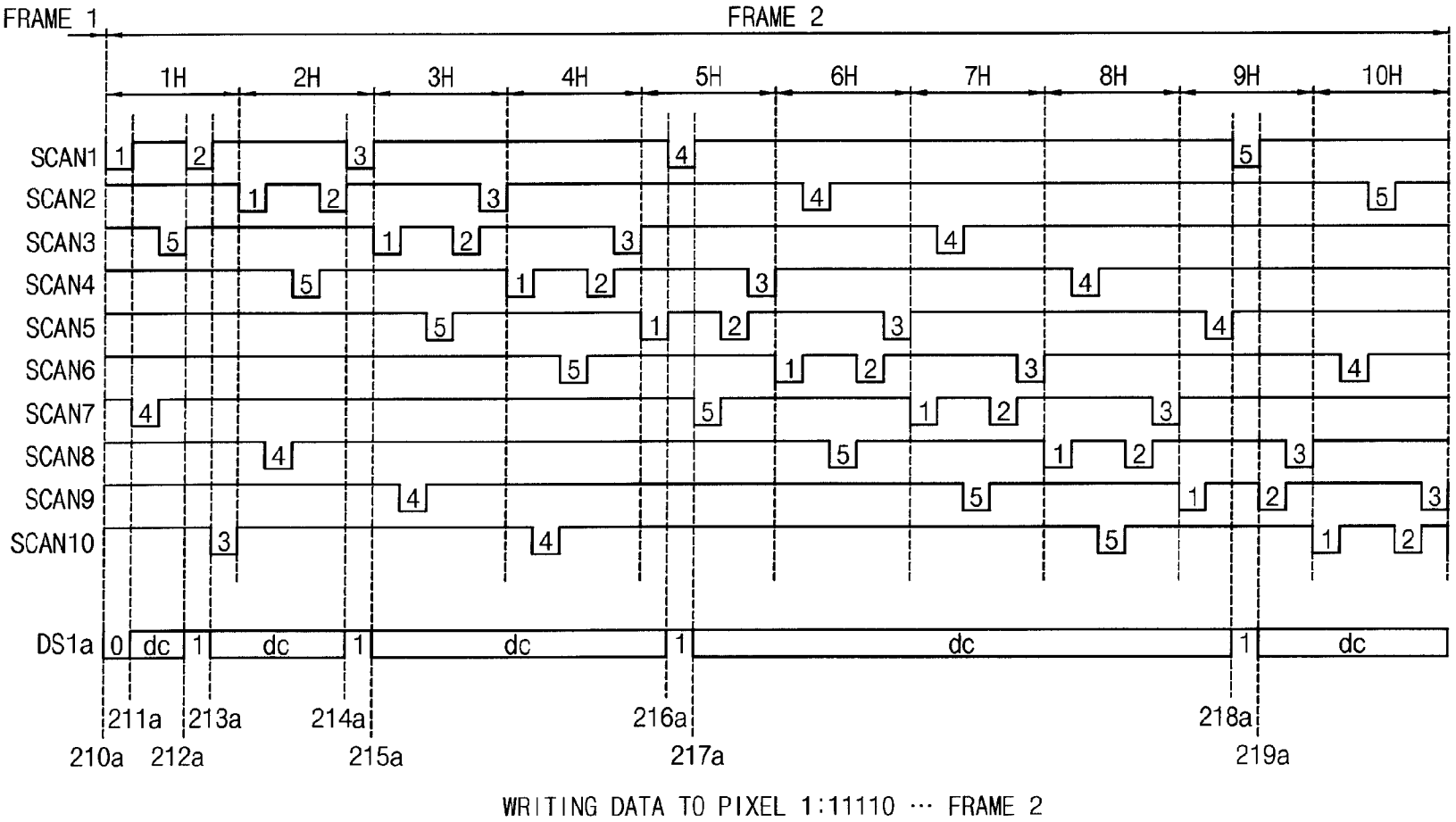
FIGS. 10 through 14 are timing diagrams illustrating a procedure of inputting data bits of sub-frames of the first pixels of FIG. 7 to the first data driving unit included in the OLED display of FIG. 6 according to the data bit input order.

FIG. 10 describes the procedure of inputting data bits 11110 of sub-frames included in the second frame FRAME 2 of the first pixel 181 to the first data driving unit DDU1 as a portion DS1*a* of the first data signal DS1 according to the data bit input order.

In a first sub display period of the first display period 1H (210*a* through 211*a*), the first scan signal SCAN1 is enabled and logical value 0 as a data bit of the first sub-frame of the first pixel 181 is inputted to the first data driving unit DDU1 as a portion DS1*a* of the first data signal DS1.

In second and third sub display periods of the first display period 1H (211*a* through 212*a*), the first scan signal SCAN1 is disabled and the first pixel 181 does not emit light because the data bit of the first sub-frame of the first pixel 181 has logical value 0.

In the fourth sub display period of the first display period 1H (212*a* through 213*a*), the first scan signal SCAN1 is enabled and logical value 1 as a data bit of the second sub-frame of the first pixel 181 is inputted to the first data driving unit DDU1 as a portion DS1*a* of the first data signal DS1.

From the fifth sub display period of the first display period 1H to the fourth sub display period of the second display period 2H (213*a* through 214*a*), the first scan signal SCAN1 is disabled and the first pixel 181 emits light because the data bit of the second sub-frame of the first pixel 181 has logical value 1.

In the fifth sub display period of the second display period 2H (214*a* through 215*a*), the first scan signal SCAN1 is enabled and logical value 1 as a data bit of the third sub-frame of the first pixel 181 is inputted to the first data driving unit DDU1 as a portion DS1*a* of the first data signal DS1.

From the first sub display period of the third display period 3H to the first sub display period of the fifth display period 5H (215*a* through 216*a*), the first scan signal SCAN1 is disabled and the first pixel 181 emits light because the data bit of the third sub-frame of the first pixel 181 has logical value 1.

In the second sub display period of the fifth display period 5H (216*a* through 217*a*), the first scan signal SCAN1 is enabled and logical value 1 as a data bit of the fourth sub-frame of the first pixel 181 is inputted to the first data driving unit DDU1 as a portion DS1*a* of the first data signal DS1.

From the second sub display period of the fifth display period 5H to the second sub display period of the ninth display period 9H (217*a* through 218*a*), the first scan signal SCAN1 is disabled and the first pixel 181 emits light because the data bit of the fourth sub-frame of the first pixel 181 has logical value 1.

In the third sub display period of the ninth display period 9H (218*a* through 219*a*), the first scan signal SCAN1 is enabled and logical value 1 as a data bit of the fifth sub-frame of the first pixel 181 is inputted to the first data driving unit DDU1 as a portion DS1*a* of the first data signal DS1.

From the fourth sub display period of the ninth display period 9H to the fifth sub display period of the tenth display period 10H (219*a* through 220*a*), the first scan signal SCAN1 is disabled and the first pixel 181 emits light because the data bit of the fifth sub-frame of the first pixel 181 has logical value 1.

In FIG. 10, the gray level of the first pixel 181 corresponds to 43 sub display periods, generated by summing the light emitting period of the second through fifth sub-frames.

Figure 11:
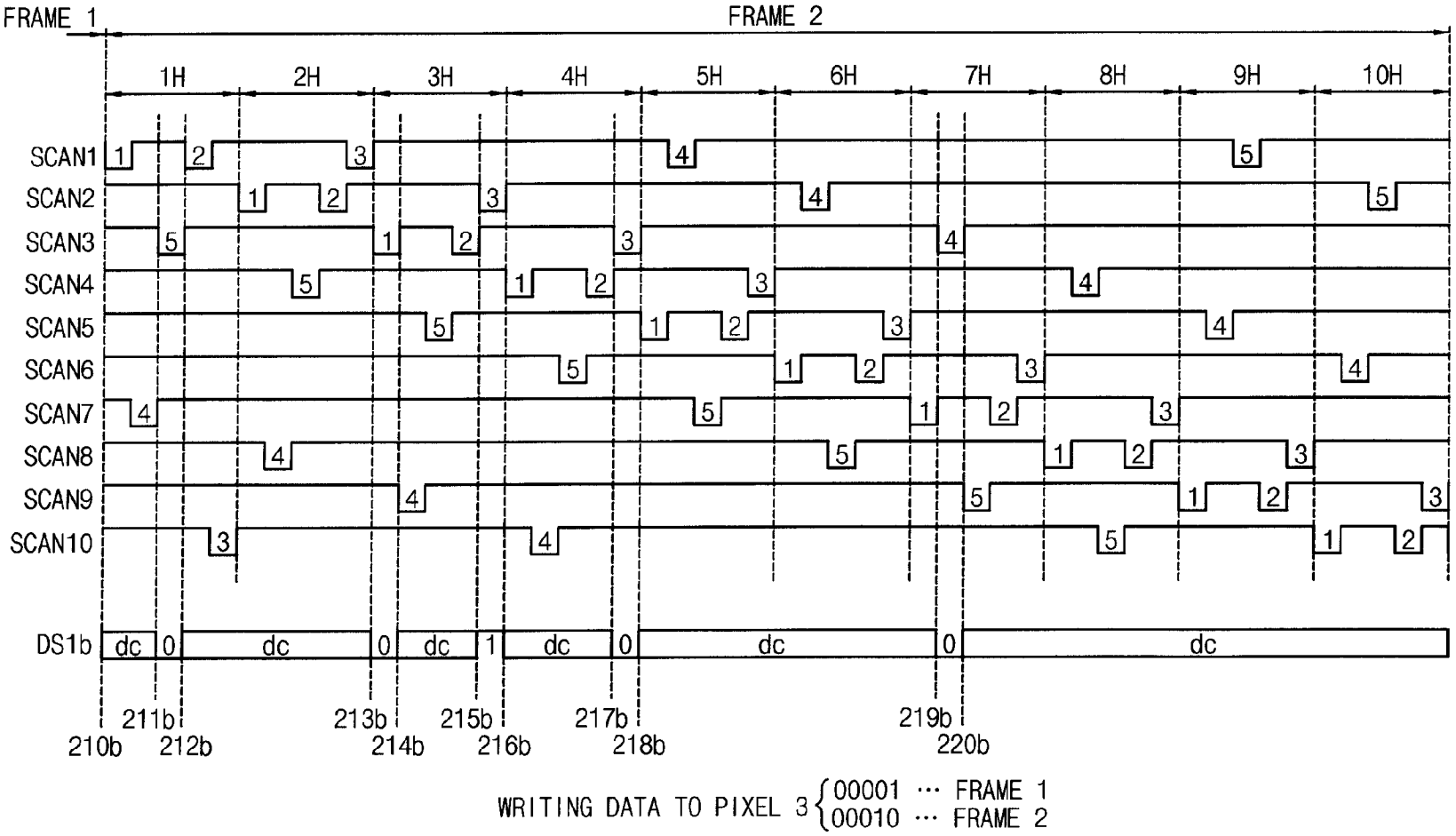

FIG. 11 describes the method of inputting a data bit 0 of the fifth sub-frame included in the first frame FRAME 1 of the third pixel 183 and data bits 0010 of the first through fourth sub-frames included in the second frame FRAME 2 of the third pixel 183 to the first data driving unit DDU1 as a portion DS1*b* of the first data signal DS1 according to the data bit input order. FIG. 11 can be understood based on the description related to FIG. 10. In FIG. 11, the gray level of the third pixel 183 corresponds to 5 sub display periods and the light emitting period of the second sub-frame included in the second frame FRAME 2 of the third pixel 183.

Figure 12:
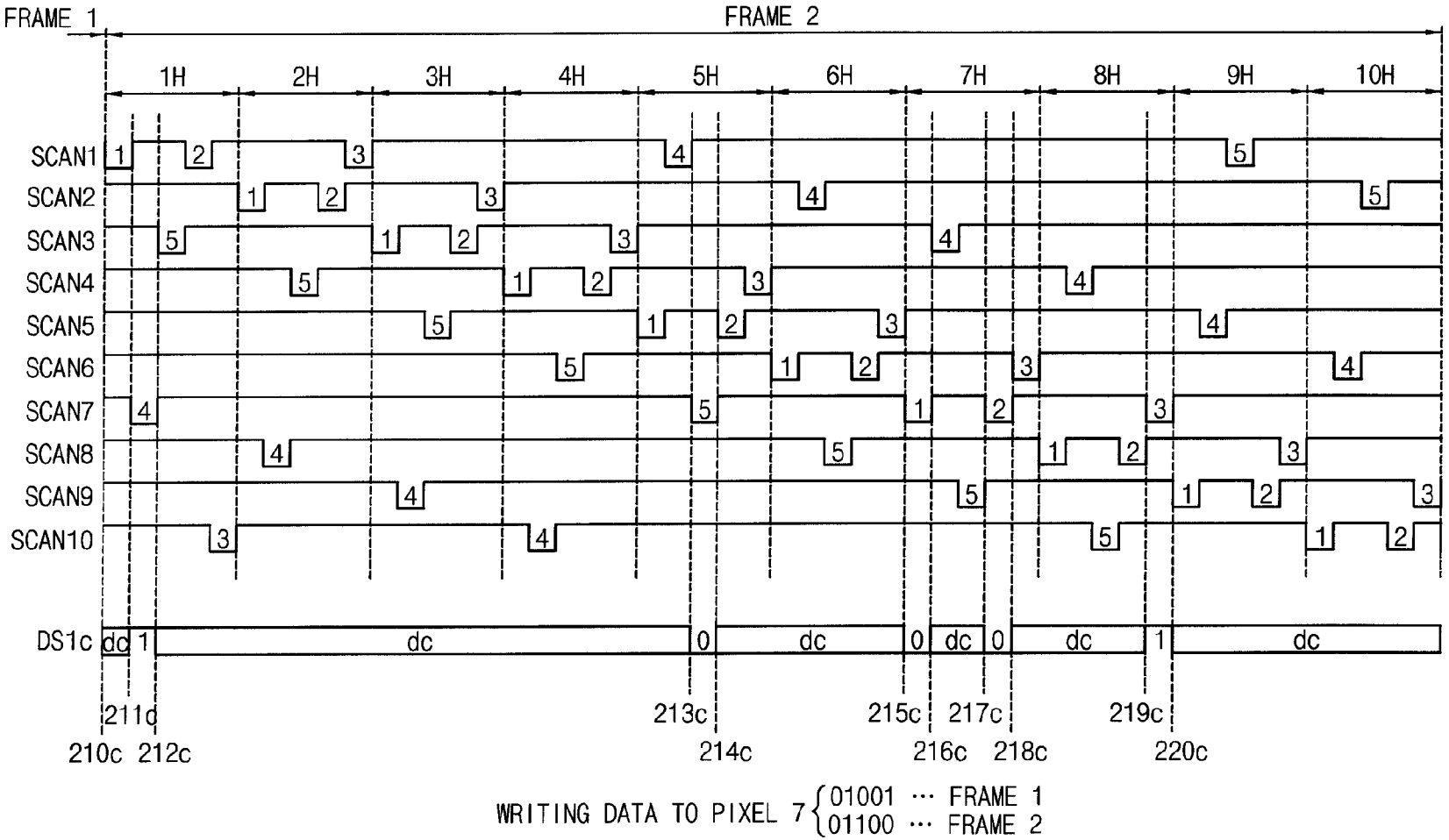

FIG. 12 describes the method of inputting data bits 01 of the fourth and fifth sub-frames included in the first frame FRAME 1 of the seventh pixel 187 and data bits 100 of the first through third sub-frames included in the second frame FRAME 2 of the seventh pixel 187 to the first data driving unit DDU1 as a portion DS1*c* of the first data signal DS1 according to the data bit input order. FIG. 12 can be understood based on the description of FIG. 10. In FIG. 12, the gray level of the seventh pixel 187 corresponds to 31 sub display periods, generated by summing the light emitting period of the third sub-frame included in the second frame FRAME 2 of the seventh pixel 187 and the light emitting period of the fourth sub-frame included in the first frame FRAME 1 of the seventh pixel 187.

Figure 13:
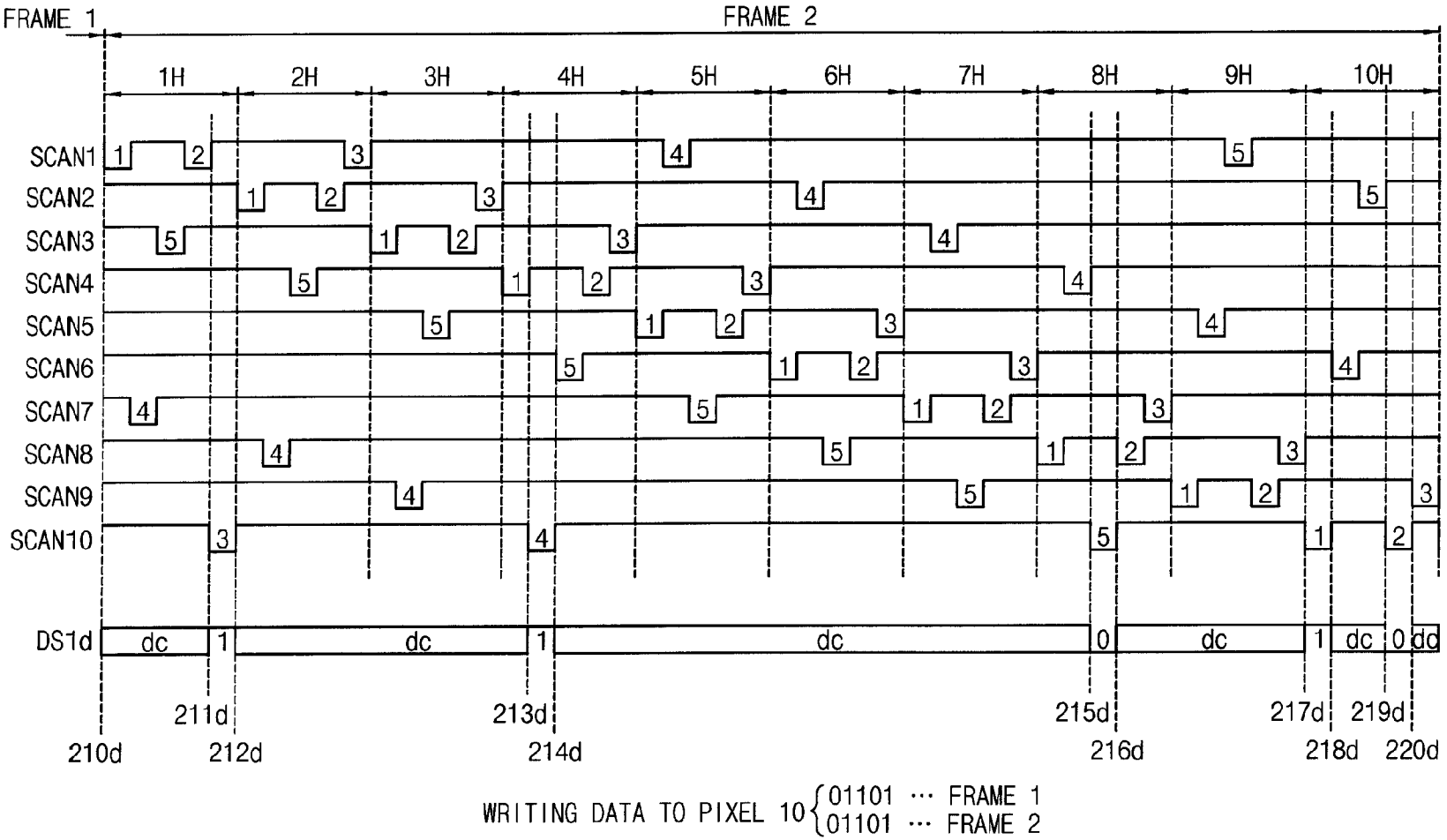

FIG. 13 describes the method of inputting data bits 011 of the third through fifth sub-frames included in the first frame FRAME 1 of the tenth pixel 190 and data bits 01 of the first and second sub-frames included in the second frame FRAME 2 of the tenth pixel 190 to the first data driving unit DDU1 as a portion DS1*d* of the first data signal DS1 according to the data bit input order. FIG. 13 can be understood based on the description of FIG. 10. In FIG. 13, the gray level of the tenth pixel 190 corresponds to 33 sub display periods, generated by summing the light emitting period of the first sub-frame included in the second frame FRAME 2 of the tenth pixel 190, the light emitting period of the third sub-frame included in the first frame FRAME 1 of the tenth pixel 190, and the light emitting period of the fourth sub-frame included in the first frame FRAME 1 of the tenth pixel 190.

Figure 14:
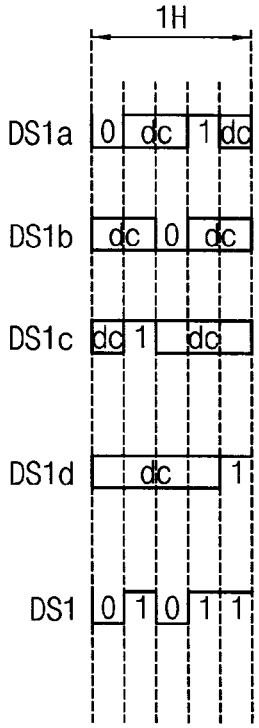

Referring to FIG. 14, the first data signal DS1 is generated by summing portions DS1*a*, DS1*b*, DS1*c*, and DS1*d* of the first data signal DS1 of FIGS. 10 through 13. In the first display period 1H, a data bit (logical value 0) of the first sub-frame of the first pixel 181, a data bit (logical value 1) of the fourth sub-frame of the seventh pixel 187, a data bit (logical value 0) of the fifth sub-frame of the third pixel 183, a data bit (logical value 1) of the second sub-frame of the first pixel 181, and a data bit (logical value 1) of the third sub-frame of the tenth pixel 190 are sequentially inputted to the first data driving unit DDU1 as the first data signal DS1 according to the data bit input order of the flow chart of FIG. 1. The first data signal DS1 has 3 logical value transitions in the first display period 1H.

FIGS. 15 through 19 are timing diagrams illustrating a method of inputting data bits of sub-frames of the first pixels of FIG. 7 to the first data driving unit included in the OLED display of FIG. 6 according to the modified data bit input order which is modified according to an example embodiment.

FIGS. 15 through 19 describe an embodiment where the data bit input order is modified such that the light emitting period of the first sub-frame of the first pixel 181 is 2 sub display periods, light emitting period of the second sub-frame of the first pixel 181 is 5 sub display periods, the light emitting period of the third sub-frame of the first pixel 181 is 12 sub display periods, the light emitting period of the fourth sub-frame of the first pixel 181 is 18 sub display periods, and the light emitting period of the fifth sub-frame of the first pixel 181 is 8 sub display periods.

Figure 15:
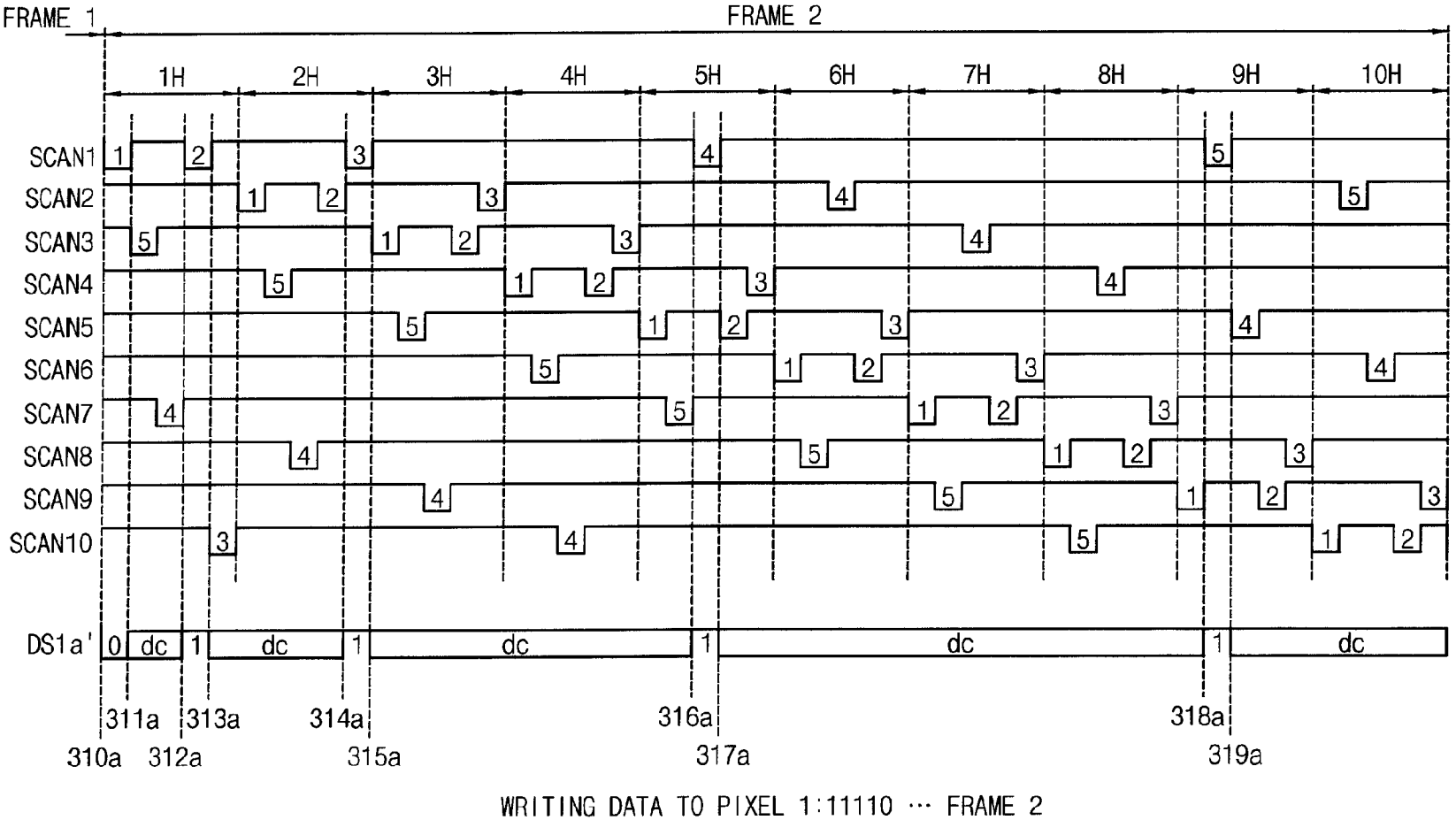
FIGS. 15 through 19 are timing diagrams illustrating a procedure of inputting data bits of sub-frames of the first pixels of FIG. 7 to the first data driving unit included in the OLED display of FIG. 6 according to the modified data bit input order which is modified according to an example embodiment.

FIG. 15 describes the method of inputting data bits 11110 of the sub-frames included in the second frame FRAME 2 of the first pixel 181 to the first data driving unit DDU1 as a portion DS1*a'* of the first data signal DS1' according to the modified data bit input order. FIG. 15 can be understood based on the description of FIG. 10. In FIG. 15, the gray level of the first pixel 181 corresponds to 43 sub display periods, generated by summing the light emitting periods of the second through fifth sub-frames included in the second frame FRAME 2 of the first pixel 181.

Figure 16:
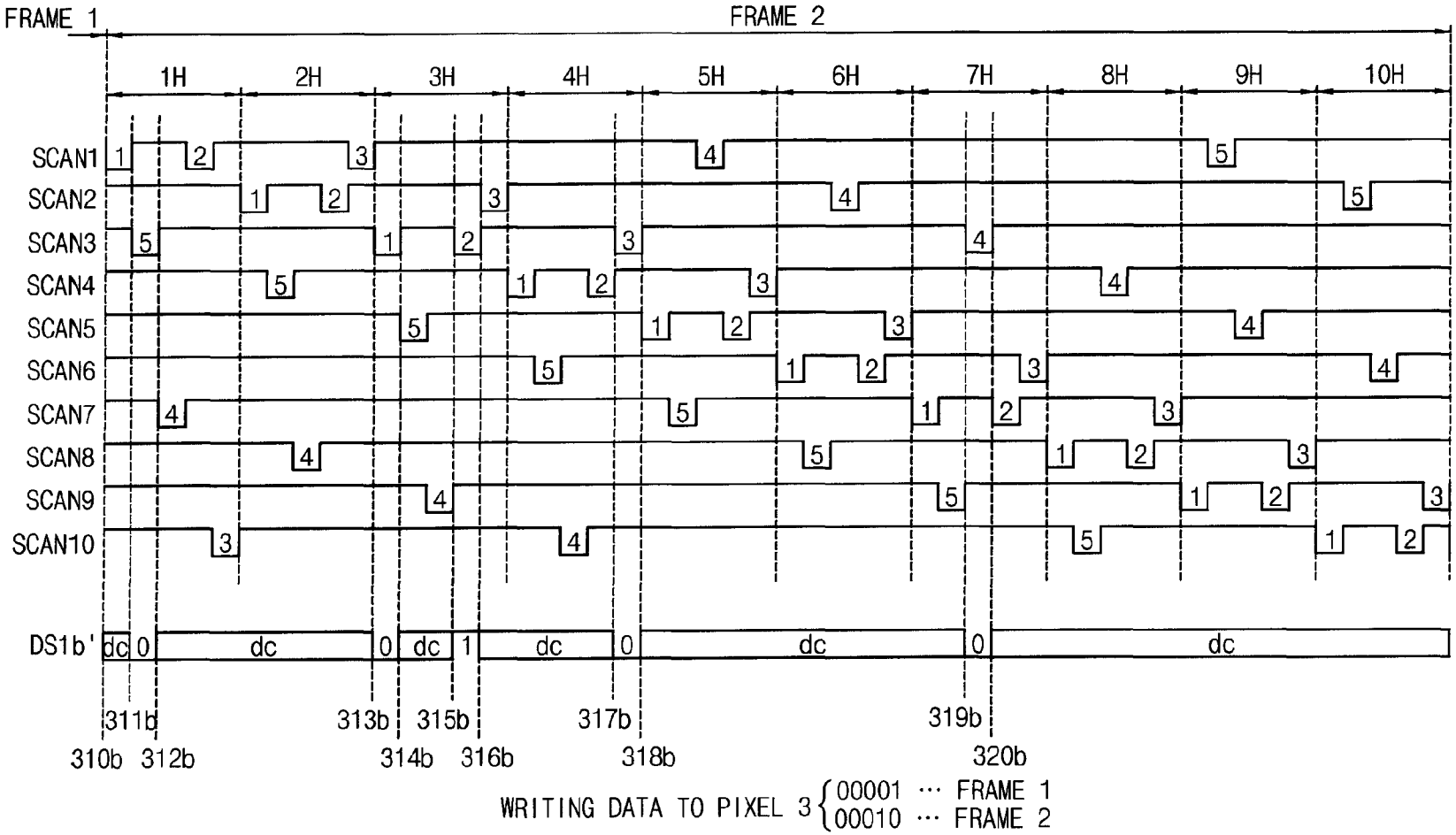

FIG. 16 describes the method of inputting a data bit 0 of the fifth sub-frame included in the first frame FRAME 1 of the third pixel 183 and data bits 0010 of the first through fourth sub-frames included in the second frame FRAME 2 of the third pixel 183 to the first data driving unit DDU1 as a portion DS1*b'* of the first data signal DS1' according to the modified data bit input order. FIG. 16 can be understood based on the description of FIG. 11. In FIG. 16, the gray level of the third pixel 183 correspond to 5 sub display periods, the light emitting period of the second sub-frame included in the second frame FRAME 2 of the third pixel 183.

Figure 17:
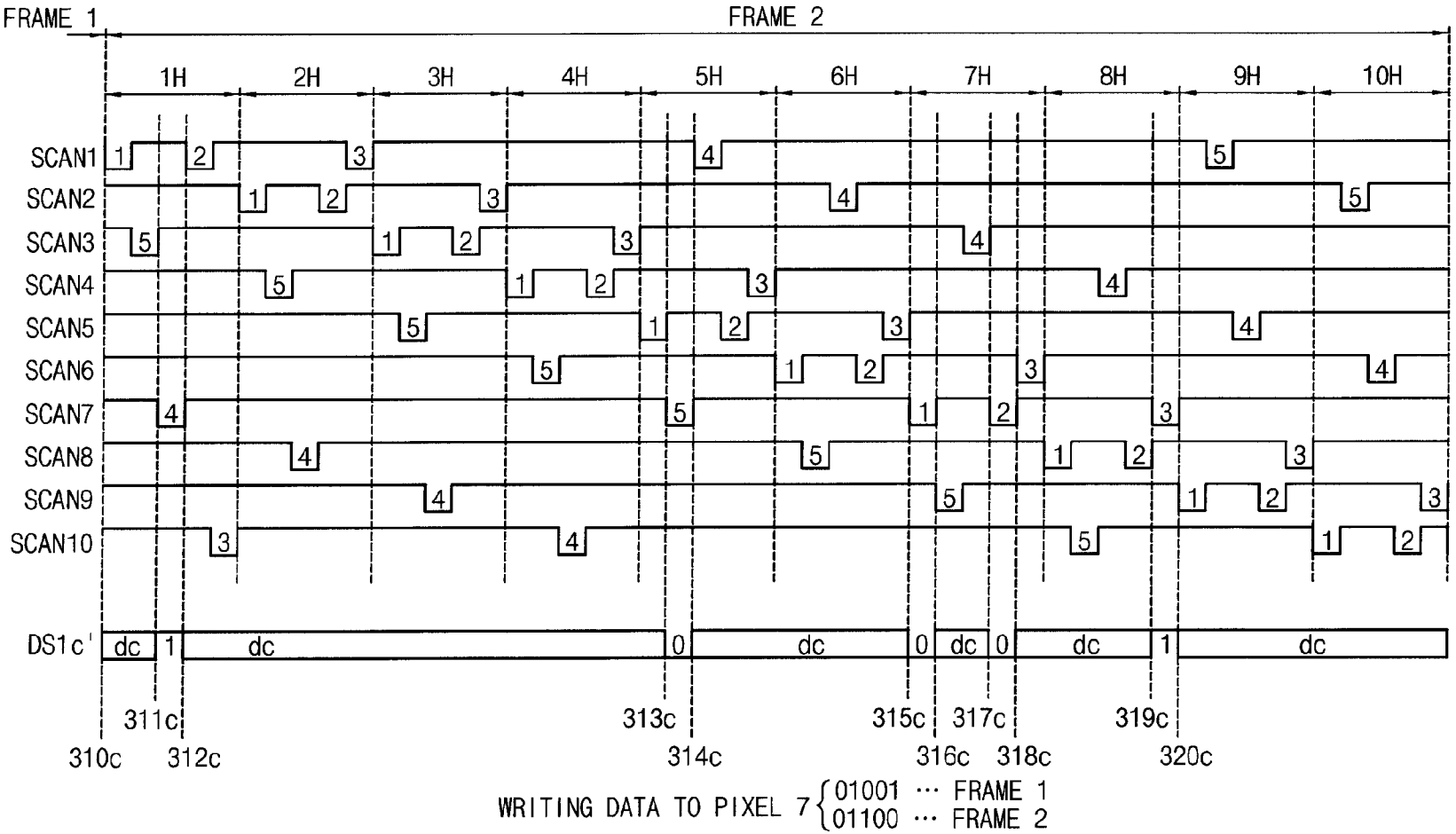

FIG. 17 describes the method of inputting data bits 01 of the fourth and fifth sub-frames included in the first frame FRAME 1 of the seventh pixel 187 and data bits 100 of the first through third sub-frames included in the second frame FRAME 2 of the seventh pixel 187 to the first data driving unit DDU1 as a portion DS1*c'* of the first data signal DS1' according to the modified data bit input order. FIG. 17 can be understood based on the description of FIG. 12. In FIG. 17, the gray level of the seventh pixel 187 corresponds to 30 sub display periods, generated by summing the light emitting period of the third sub-frame included in the second frame FRAME 2 of the seventh pixel 187 and the light emitting period of the fourth sub-frame included in the first frame FRAME 1 of the seventh pixel 187.

Figure 18:
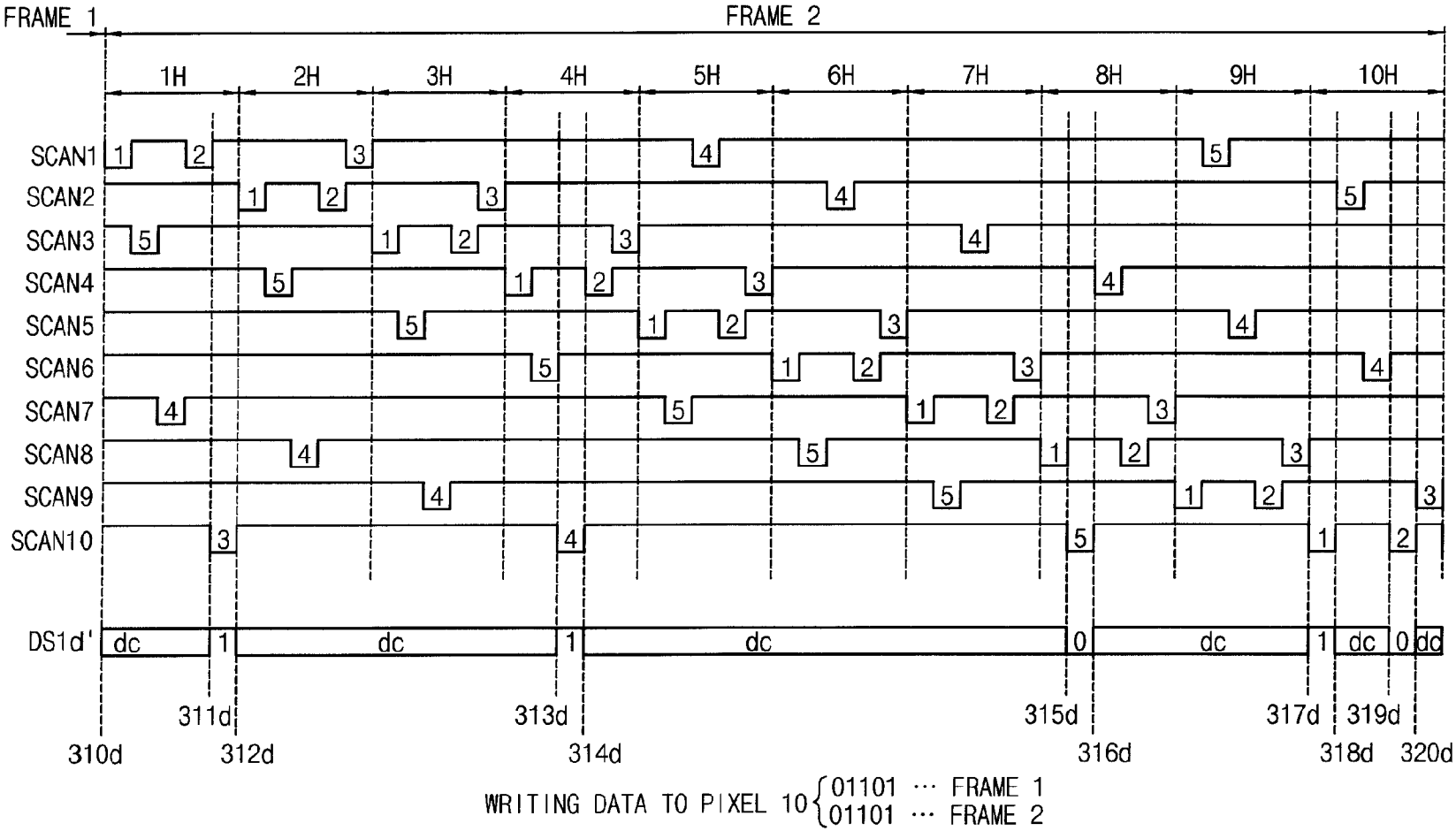

FIG. 18 describes the procedure of inputting data bits 011 of the third to fifth sub-frames included in the first frame FRAME 1 of the tenth pixel 190 and data bits 01 of the first and second sub-frames included in the second frame FRAME 2 of the tenth pixel 190 to the first data driving unit DDU1 as a portion DS1*d'* of the first data signal Ds1' according to the modified data bit input order. FIG. 18 can be understood based on the description of FIG. 13. In FIG. 18, the gray level of the tenth pixel 190 corresponds to 32 sub display periods, generated by summing the light emitting period of the first sub-frame included in the second frame FRAME 2 of the tenth pixel 190, the light emitting period of the third sub-frame included in the first frame FRAME 1 of the tenth pixel 190, and the light emitting period of the fourth sub-frame included in the first frame FRAME 1 of the tenth pixel 190.

Figure 19:
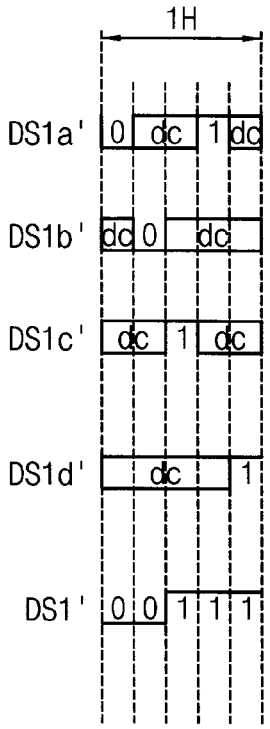
Figure 20:
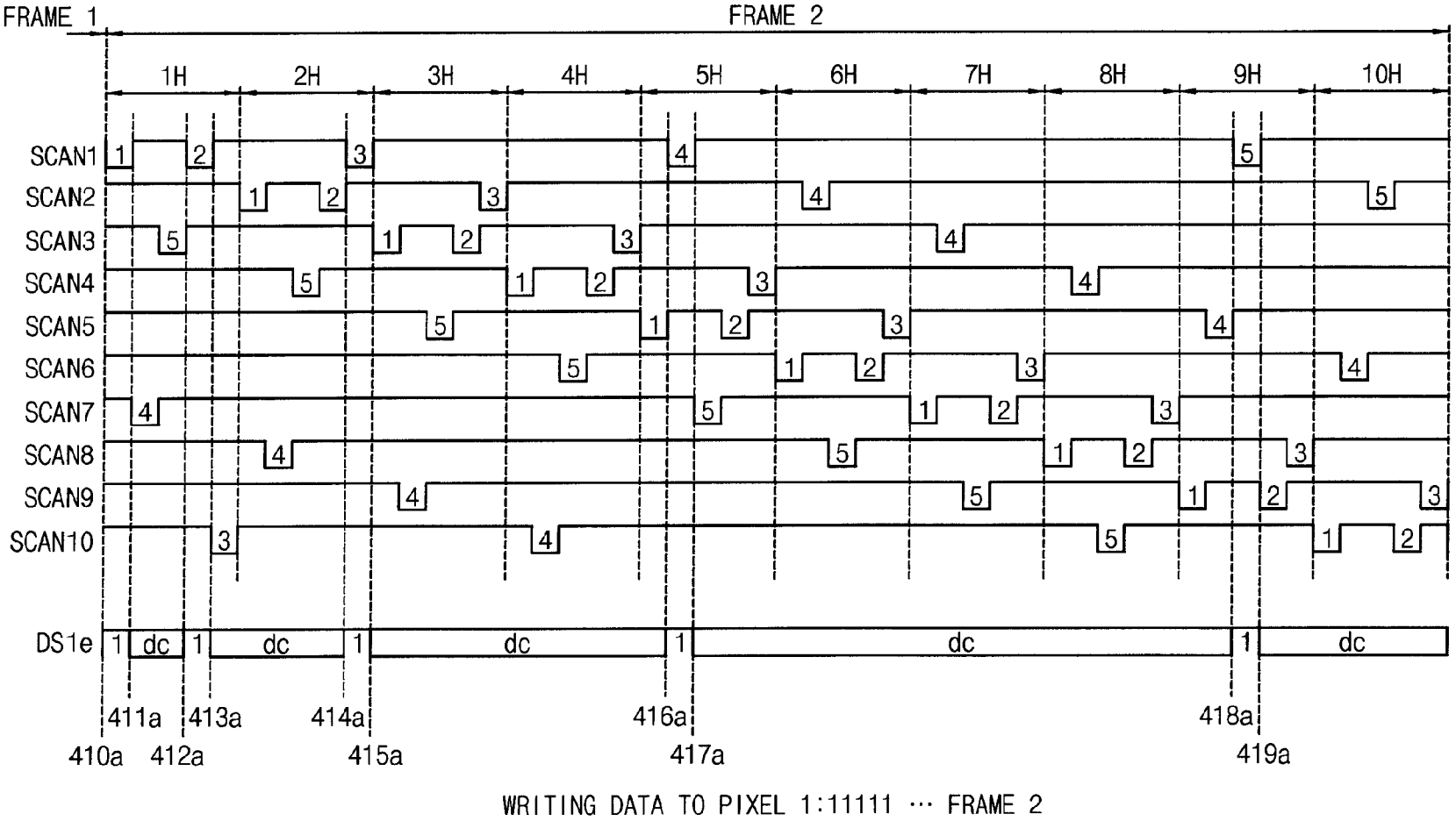
FIGS. 20 through 24 are timing diagrams illustrating a procedure of inputting data bits of sub-frames of the first pixels of FIG. 7 to the first data driving unit included in the OLED display of FIG. 6 according to the data bit input order.
Figure 21:
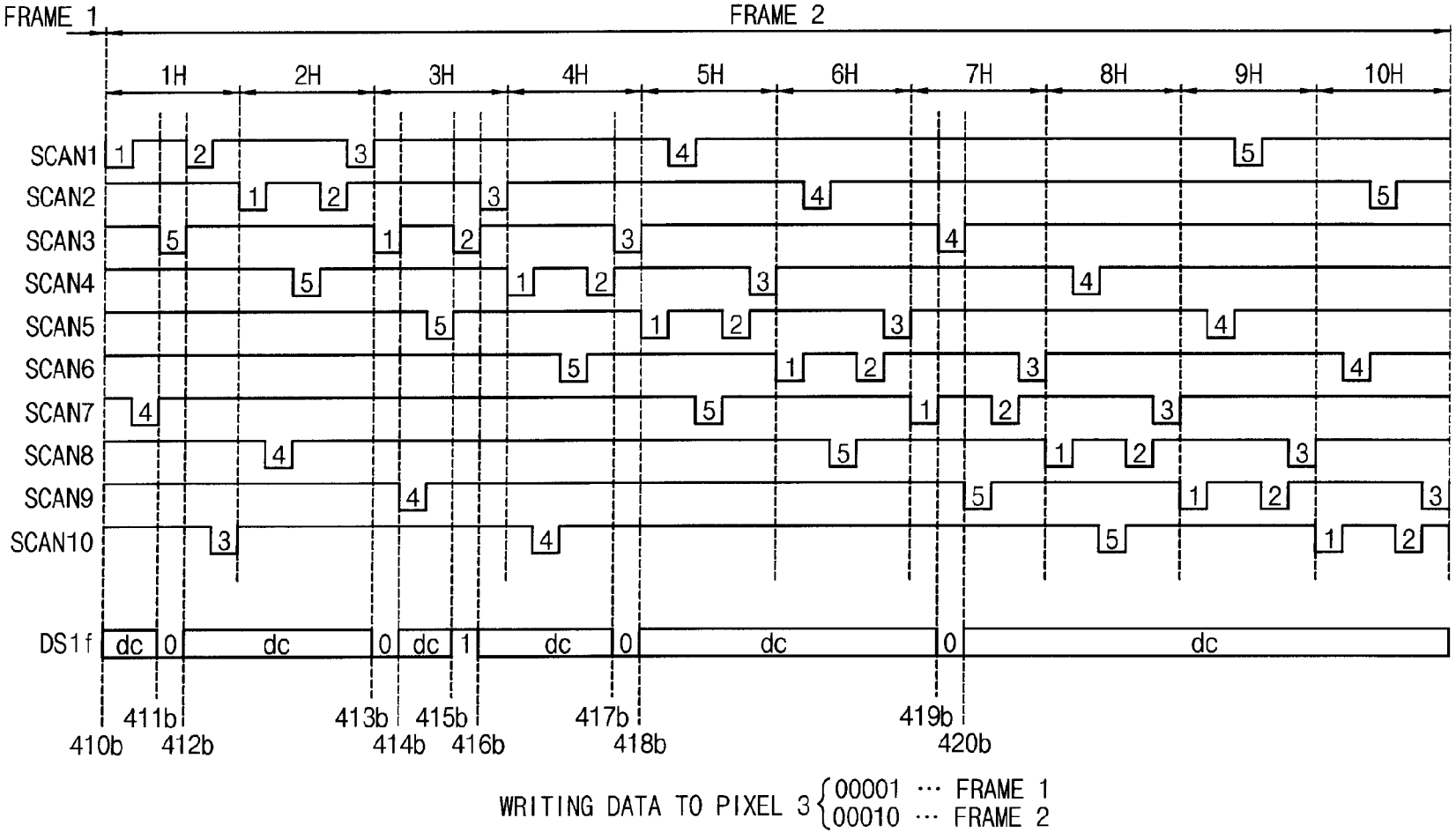
Figure 22:
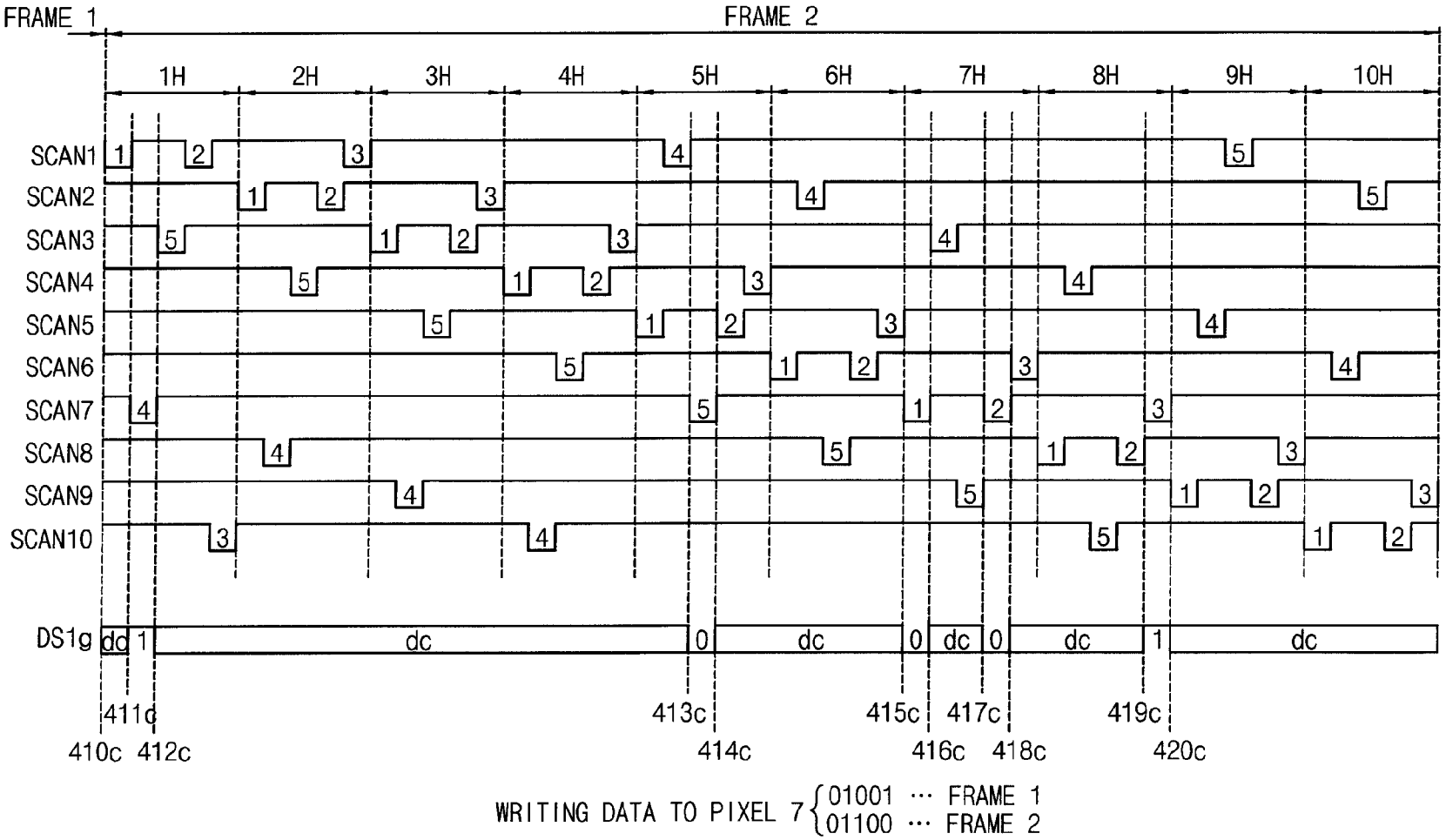
Figure 23:
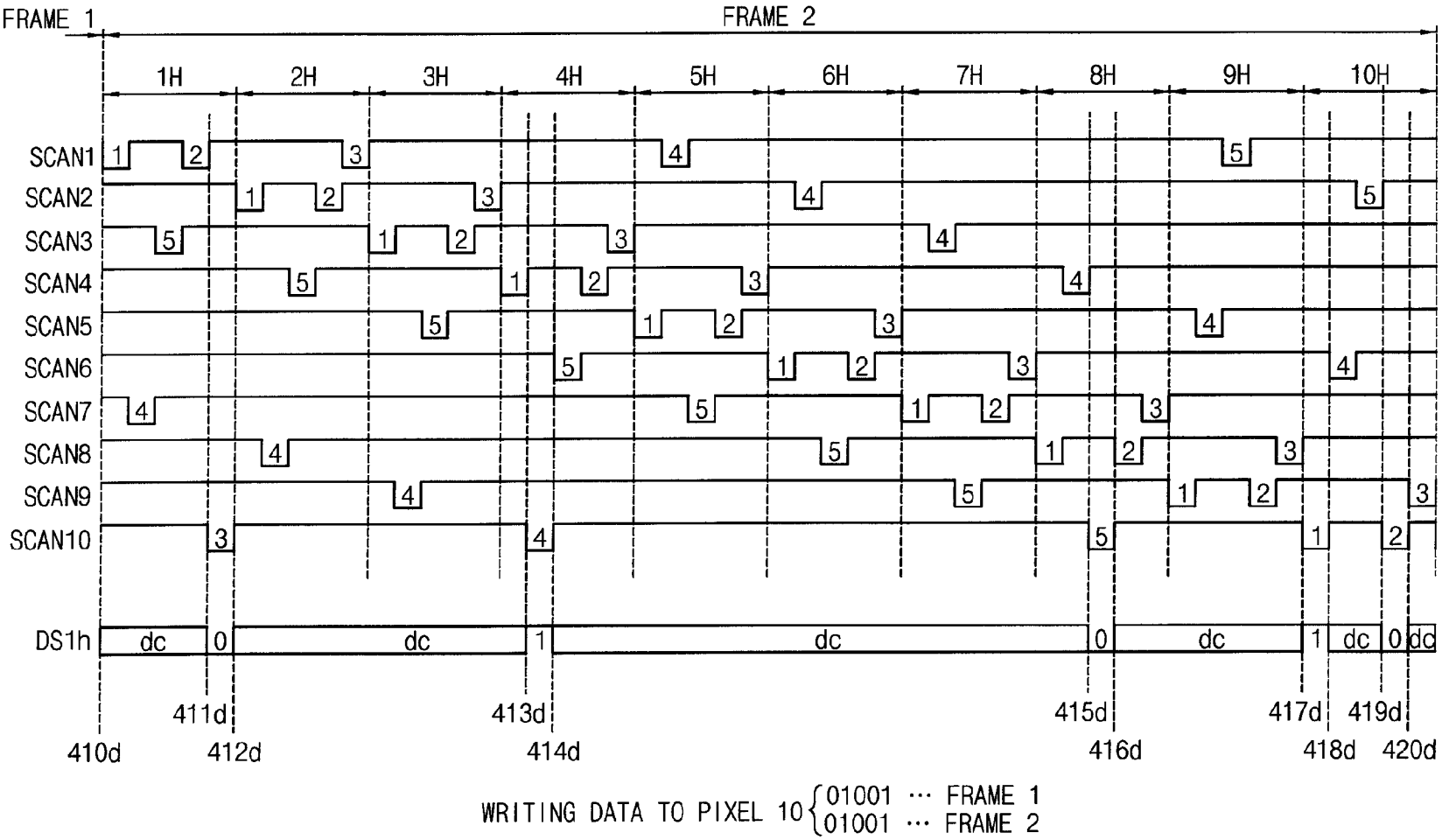

Referring to the embodiment of FIG. 19, the first data signal DS1' is generated by summing portions DS1*a'*, DS1*b'*, DS1*c'*, and DS1*d'* of the first data signal DS1' of FIGS. 15 through 18. In the first display period 1H, a data bit (logical value 0) of the first sub-frame of the first pixel 181, a data bit (logical value 0) of the fifth sub-frame of the third pixel 183, a data bit (logical value 1) of the fourth sub-frame of the seventh pixel 187, a data bit (logical value 1) of the second sub-frame of the first pixel 181, and a data (logical value 1) of the third sub-frame of the tenth pixel 190 are sequentially inputted to the first data driving unit DDU1 as the first data signal Ds1' according to the modified data bit input order. The first data signal DS1' has 1 logical value transition in the first display period 1H.

The charging/discharging count (i.e., the number of logical value transitions) of the first data driving unit DDU1 operated by the first data signal Ds1' according to the modified data bit input order (FIG. 19) is a third of the charging/discharging count of the first data driving unit DDU1 operated by the first data signal DS1 according to the data bit input order (FIG. 14). In other words, the first data driving unit DDU1 operated by the first data signal DS1' according to the modified data bit input order (FIG. 19) consumes less power than the first data driving unit DDU1 operated by the first data signal DS1 according to the data bit input order (FIG. 14).

The gray levels of the pixels 181, 183, 187, and 190 driven according to the modified data bit input order have ignorable error compared to the gray levels of the pixels 181, 183, 187, and 190 driven according to the original data bit input order.

FIGS. 10 through 19 describe the steps S122, S123*b*, and S124*b*.

In FIGS. 10 through 19, since the input order of a least significant bit is already first in the data bit input order, there is no change to the data bit input order of the least significant bit of the first data bits when the least significant bit has logical value 0 (S123*b*).

FIGS. 20 through 24 are timing diagrams illustrating a method of inputting data bits of sub-frames of the first pixels of FIG. 7 to the first data driving unit included in the OLED display of FIG. 6 according to the data bit input order.

FIGS. 20 through 23 can be understood based on the description of FIGS. 10 through 13.

Figure 24:
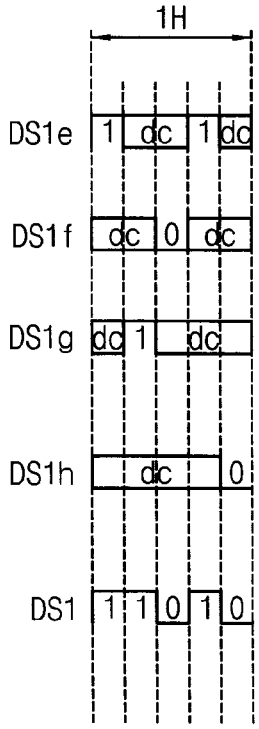
Figure 25:
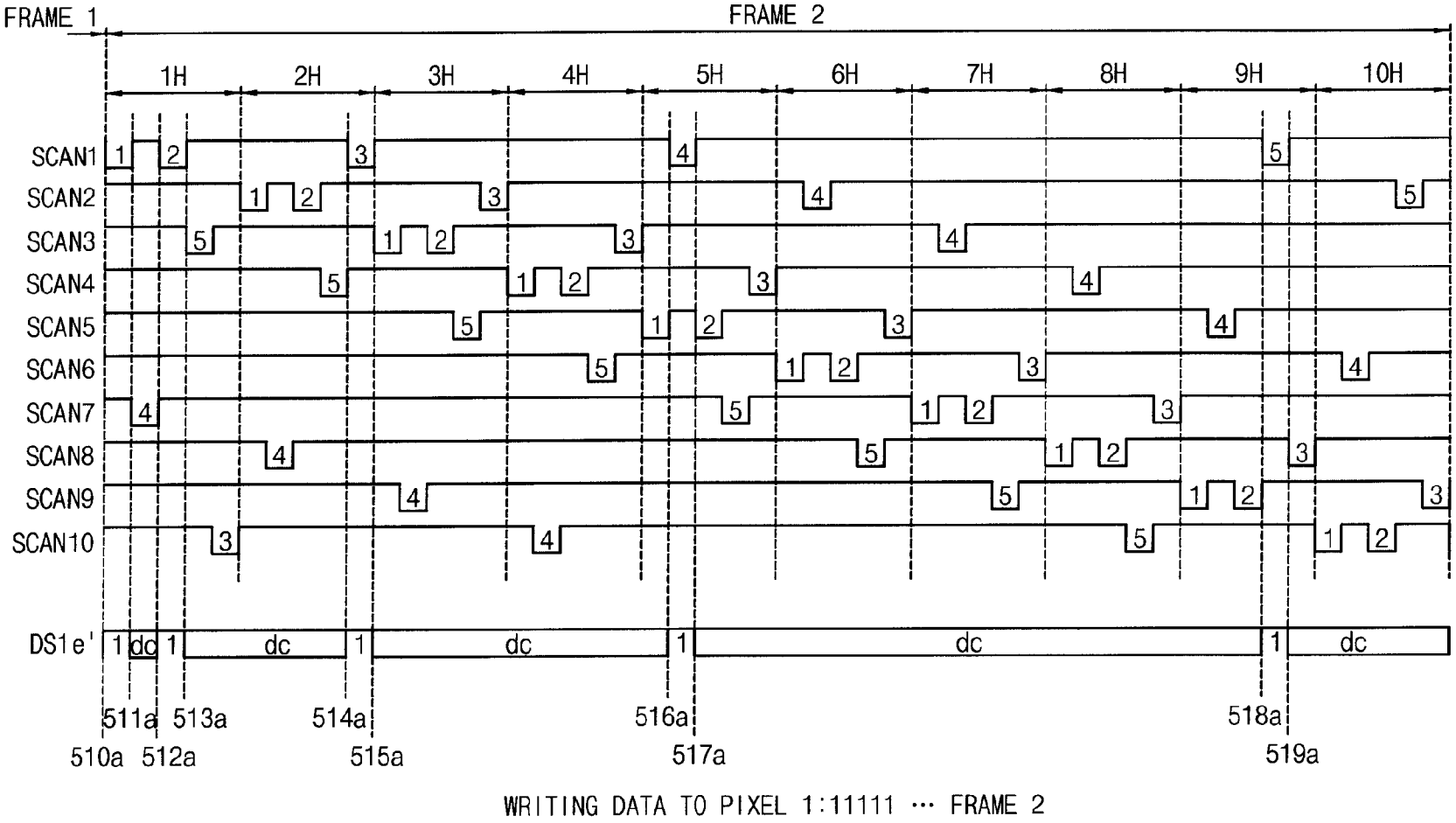
FIGS. 25 through 29 are timing diagrams illustrating a procedure of inputting data bits of sub-frames of the first pixels of FIG. 7 to the first data driving unit included in the OLED display of FIG. 6 according to the modified data bit input order which is modified according to an example embodiment.
Figure 26:
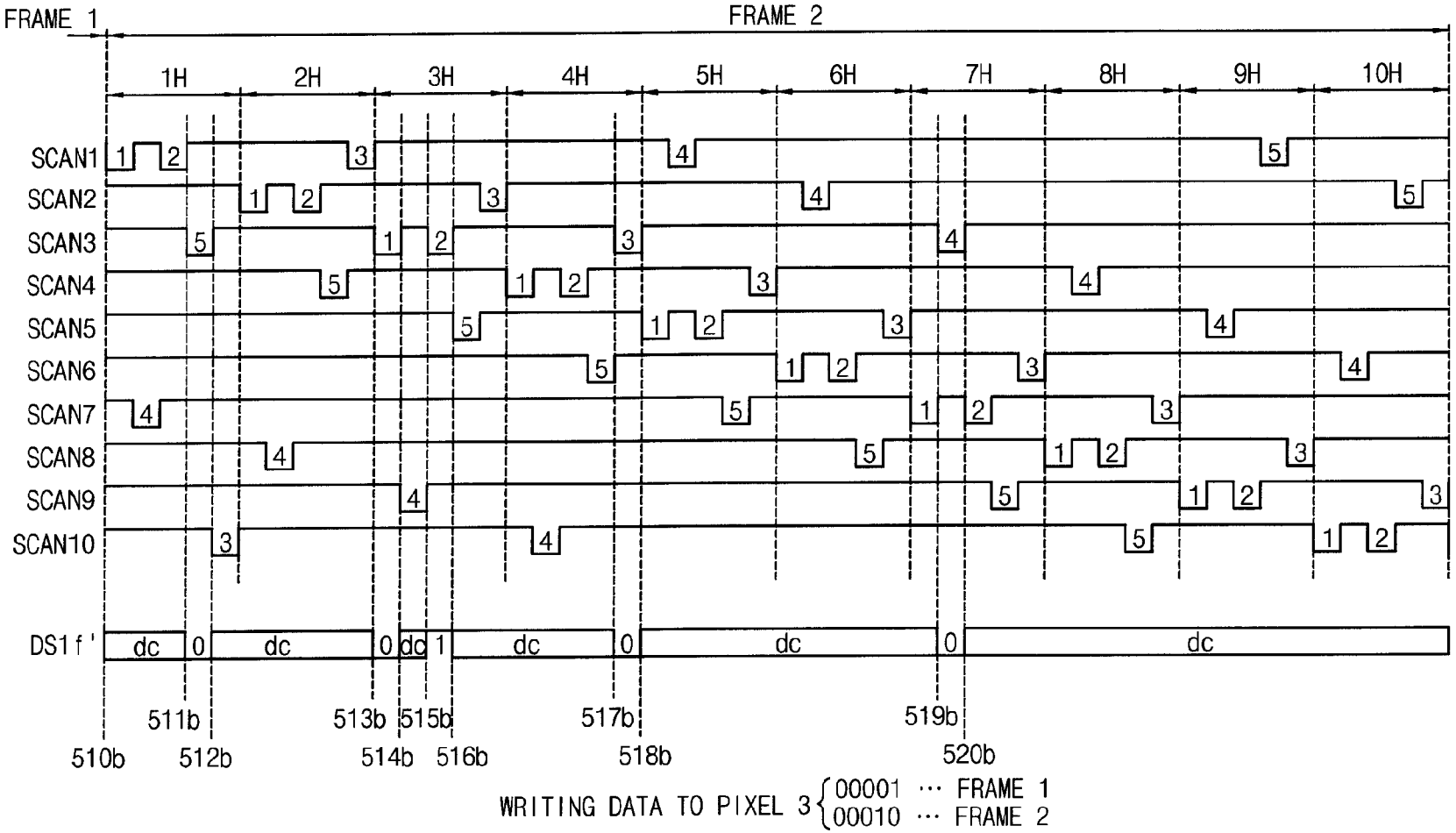
Figure 27:
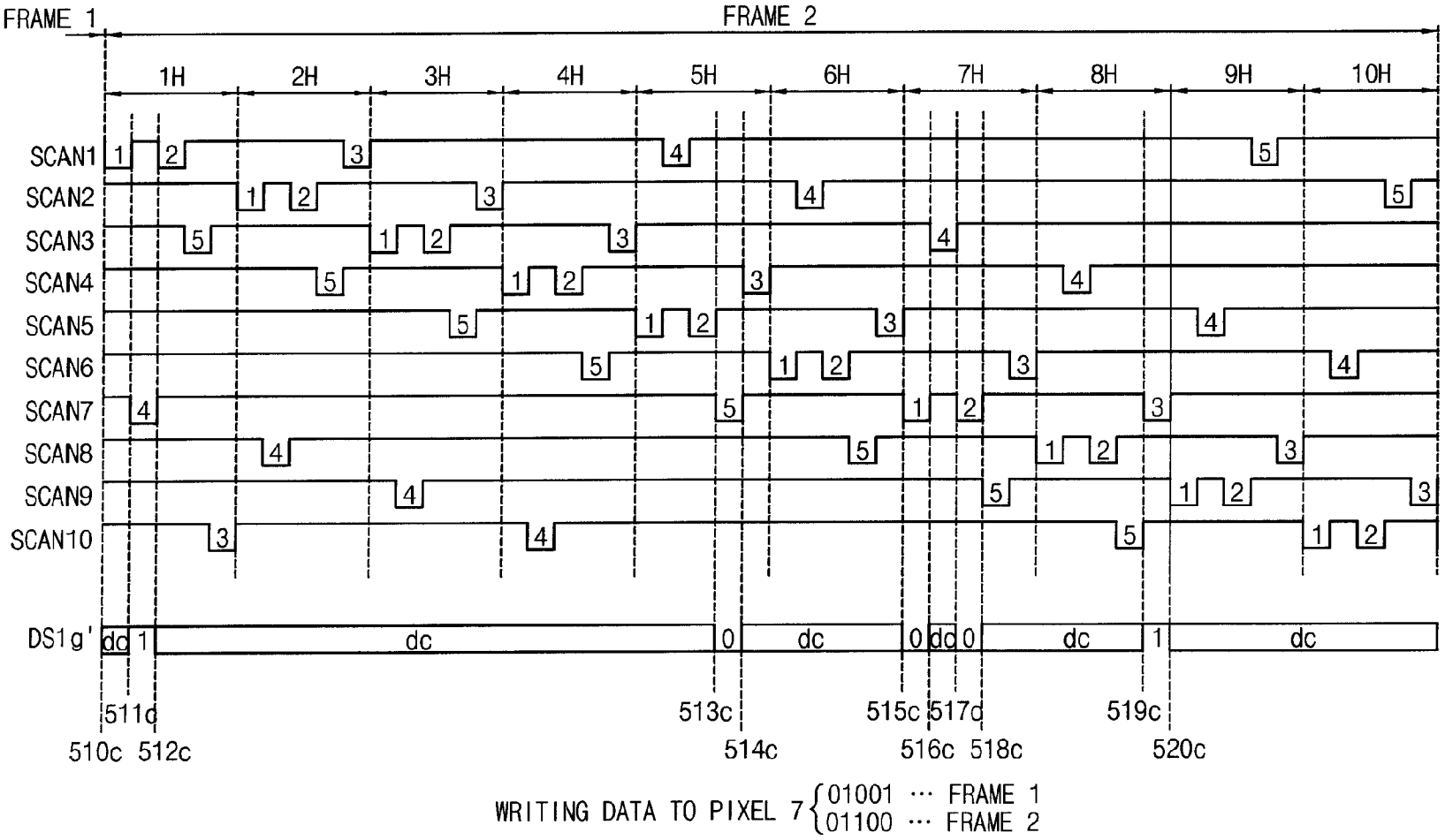
Figure 28:
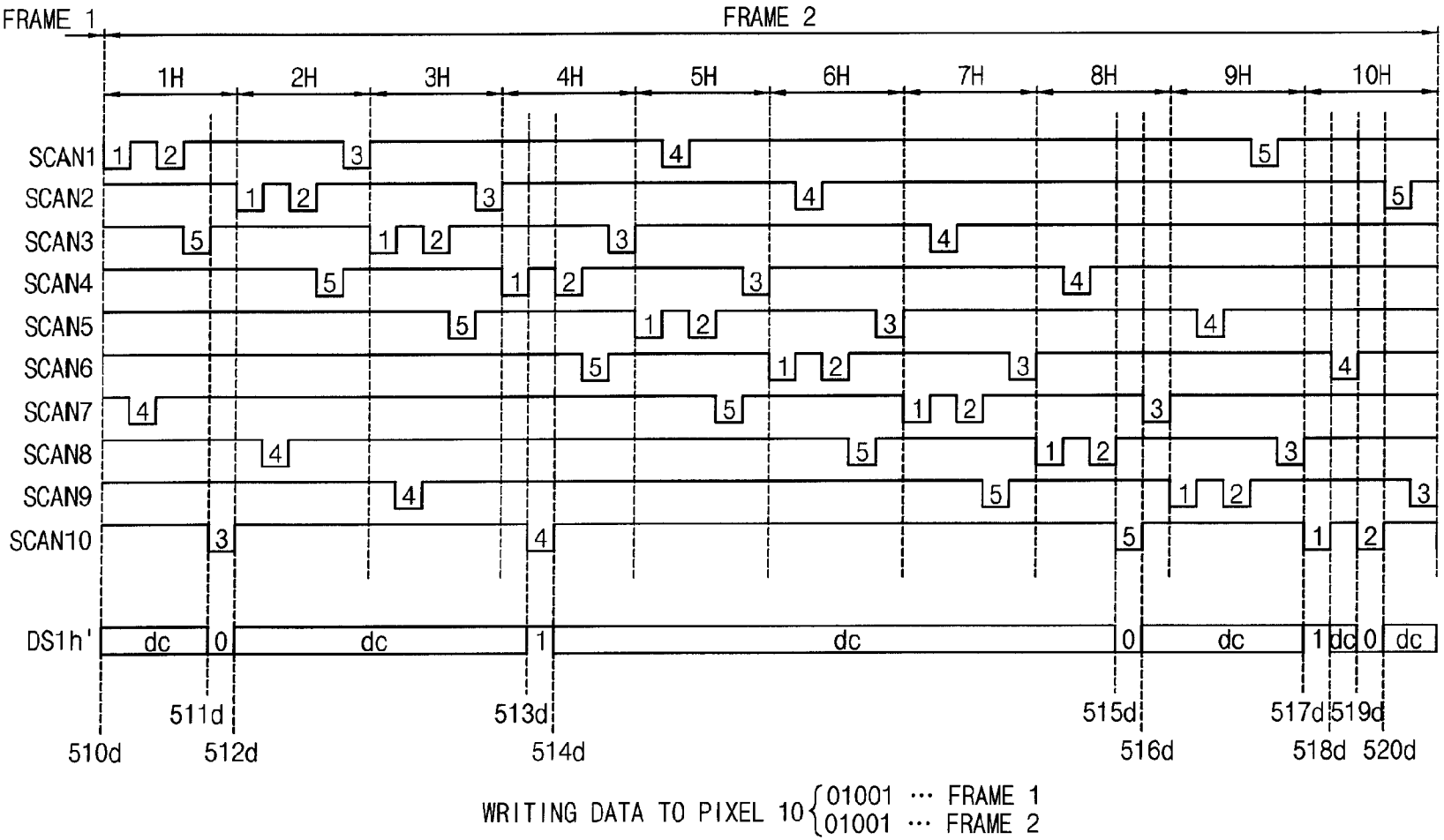

Referring to FIG. 24, the first data signal DS1 is generated by summing portions DS1*e*, DS1*f*, DS1*g*, and DS1*h* of the first data signal DS1 of FIGS. 20 through 23. In the first display period 1H, a data bit (logical value 1) of the first sub-frame of the first pixel 181, a data bit (logical value 1) of the fourth sub-frame of the seventh pixel 187, a data bit (logical value 0) of the fifth sub-frame of the third pixel 183, a data bit (logical value 1) of the second sub-frame of the first pixel 181, and a data (logical value 0) of the third sub-frame of the tenth pixel 190 are sequentially inputted to the first data driving unit DDU1 as the first data signal DS1 according to the data bit input order of the flow chart of FIG. 1. The first data signal DS1 has 3 logical value transitions in the first display period 1H.

FIGS. 25 through 29 are timing diagrams illustrating a method of inputting data bits of sub-frames of the first pixels of FIG. 7 to the first data driving unit included in the OLED display of FIG. 6 according to the modified data bit input order which is modified according to an example embodiment.

FIGS. 25 through 28 can be understood based on the description of FIGS. 15 through 18.

Figure 29:
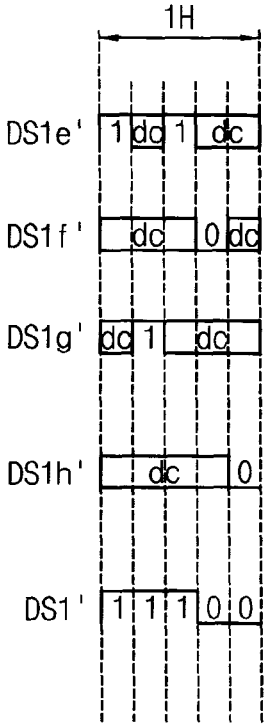

Referring to the embodiment of FIG. 29, the first data signal DS1' is generated by summing portions DS1*e*', DS1*f*', DS1*g*', and DS1*h*' of the first data signal DS1' of FIGS. 25 through 28. In the first display period 1H, a data bit (logical value 1) of the first sub-frame of the first pixel 181, a data bit (logical value 1) of the fourth sub-frame of the seventh pixel 187, a data bit (logical value 1) of the second sub-frame of the first pixel 181, a data bit (logical value 0) of the fifth sub-frame of the third pixel 183, and a data (logical value 0) of the third sub-frame of the tenth pixel 190 are sequentially inputted to the first data driving unit DDU1 as the first data signal DS1' according to the modified data bit input order. The first data signal DS1' has 1 logical value transition in the first display period 1H.

The charging/discharging count (i.e., the number of logical value transitions) of the first data driving unit DDU1 operated by the first data signal Ds1' according to the modified data bit input order (FIG. 29) is a third of the charging/discharging count of the first data driving unit DDU1 operated by the first data signal DS1 according to the data bit input order (FIG. 24). In other words, the first data driving unit DDU1 operated by the first data signal DS1' according to the modified data bit input order (FIG. 29) consumes less power than the first data driving unit DDU1 operated by the first data signal DS1 according to the original data bit input order (FIG. 24).

The gray levels of the pixels 181, 183, 187, and 190 driven according to the modified data bit input order have ignorable error compared to the gray levels of the pixels 181, 183, 187, and 190 driven according to the data bit input order.

FIGS. 20 through 29 describe the steps S122, S123*a*, and S124*a*.

In FIGS. 20 through 29, since the input order of a least significant bit is already first in the data bit input order, there is no change in the data bit input order by modifying the data bit input order such that the input order of the least significant bit of the first data bits is first in the data bit input order when the least significant bit has logical value 1 (S123*a*).

Figure 30:
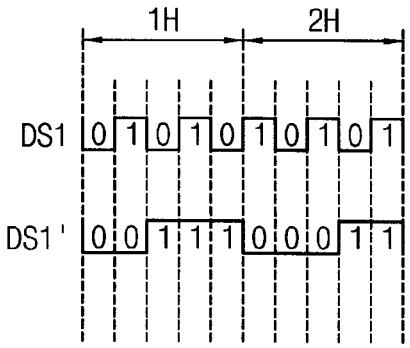
FIGS. 30 and 31 are timing diagrams illustrating exchanging the input orders of the data bits of the plurality of the sub-frames on the data bit input order included in the flow chart of FIG. 3.
Figure 31:
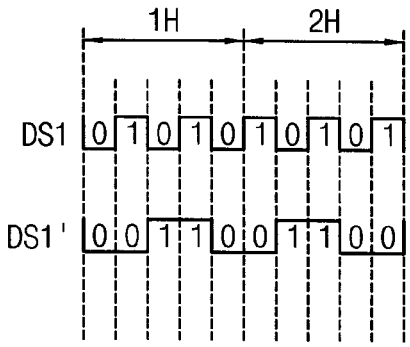

FIGS. 30 and 31 are timing diagrams illustrating exchanging the input orders of the data bits of the sub-frames on the data bit input order included in the flow chart of FIG. 3.

FIG. 30 illustrates an example where an input order of the second data bit in sequential 3 data bits of the first data signal DS1 is exchanged with an input order of the third data bit in the sequential 3 data bits of the first data signal DS1. In the first and second display periods 1H and 2H, the first data signal DS1 according to the data bit input order has 9 logical value transitions. On the contrary, in the first and second display periods 1H and 2H, the first data signal DS1' according to the modified data bit input order has 3 logical value transitions.

FIG. 31 illustrates an example where an input order of the second data bit in sequential 4 data bits of the first data signal DS1 is exchanged with an input order of the third data bit in the sequential 4 data bits of the first data signal DS1. In the first and second display periods 1H and 2H, the first data signal DS1 according to the data bit input order has 9 logical value transitions. On the contrary, in the first and second display periods 1H and 2H, the first data signal DS1' according to the modified data bit input order has 4 logical value transitions.

Figure 32:
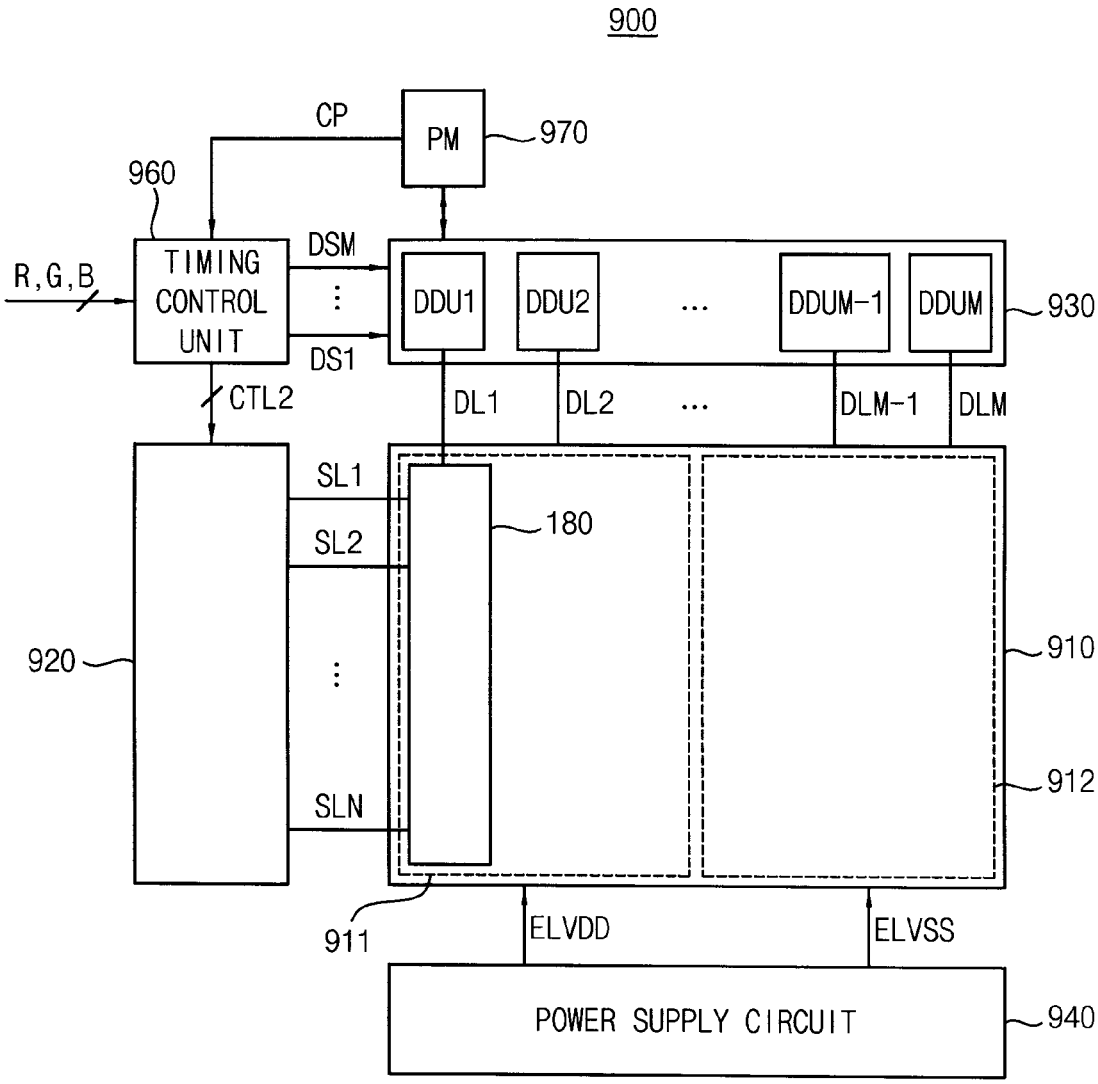
FIG. 32 is a block diagram illustrating an OLED display according to an example embodiment.

FIG. 32 is a block diagram illustrating an OLED display according to an example embodiment.

Referring to FIG. 32, the organic light-emitting diode (OLED) display 900 includes a display panel 910, a scan driving circuit 920, a data driving circuit 930, a power supply circuit 940, a power measurement unit 970, and a timing control circuit 960. The display panel 910 includes a first pixel region 911 and a second pixel region 912. The first pixel region 910 includes the first pixels 180. The data driving circuit 930 includes a first data driving unit DDU1, a second data driving unit DDU2 through a (M−1)-th data driving unit DDUM-1, and a (M)-th data driving unit DDUM.

The display panel 910 is connected to the scan driving circuit 920 through a plurality of scan lines SL1 through SLN. The display panel 910 is connected to the data driving circuit 930 through a plurality of data lines DL1 through DLM. In detail, pixels included in the first pixel region 910 are connected to the first and second data driving units DDU1 and DDU2 through the first and second data lines DL1 and DL2. Pixels included in the second pixel region 920 are connected to the (M−1)-th and (M)-th data driving unit DDUM-1 and DDUM through the (M−1)-th and (M)-th data lines DLM-1 and DLM.

The timing control circuit 960 generates a scan driving circuit control signal CTL2 controlling the scan driving circuit 920 based on the input image pixel data R, G, and B. The timing control circuit 960 generates first and second data bits according to a first data bit input order based on the input image pixel data R, G, and B. The timing control circuit 960 provides the first and second data to the data driving circuit 930 as the first and second data signals DS1 and DS2. The timing control circuit 960 generates (M−1)-th and (M)-th data bits according to a second data bit input order based on the input image pixel data R, G, and B. The timing control circuit 960 provides the (M−1)-th and (M)-th data bits to the data driving circuit 930 as the (M−1)-th and (M)-th data signals DSM-1 and DSM.

The scan driving circuit 920 provides scan signals based on the scan driving circuit control signal CTL2 to the display panel 910 through the scan lines SL1 through SLN.

The data driving circuit 930 provides first through (M)-th pixel data signals based on the first through (M)-th data signals DS1 through DSM to pixels included in the display panel 910 through the data lines DL1 through DLM.

In an example embodiment, the power measurement unit 970 measures the current of the data driving circuit 930 and calculates the power consumption CP of the data driving circuit 930 based on the current. In another example embodiment, the power measurement unit 970 calculates the power consumption CP of the data driving circuit 930 based on the number of the logical value transitions of the first through (M)-th data signals DS1 through DSM.

The timing control circuit 960 modifies the first and second data bit input orders based on the power consumption CP of the data driving circuit 930. The timing control circuit 960 generates first through (M)-th data bits according to the modified first data bit input order and the modified second data input order and provides the first through (M)-th data bits as the first through (M)-th data signals DS1 through DSM to the data driving circuit 930. The modifying method of the data bit input order is described with reference to FIGS. 9 through 31.

The power supply circuit 940 provides the high power supply voltage ELVDD and the low power supply voltage ELVSS to the display panel 910.

Figure 33:
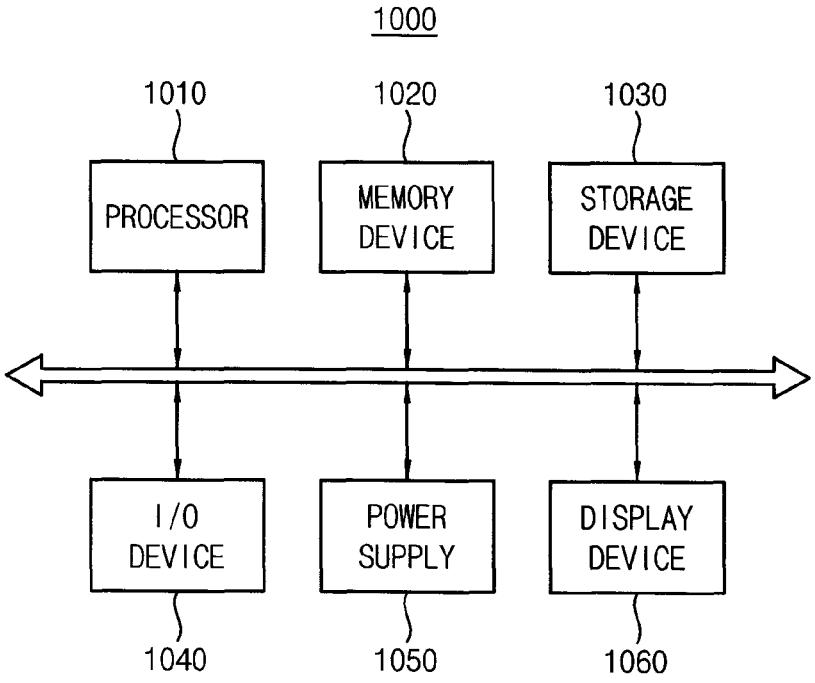
FIG. 33 is a block diagram illustrating an electronic device including an OLED display according to an example embodiment.

FIG. 33 is a block diagram illustrating an electronic device including an OLED display according to an example embodiment.

Referring to FIG. 33, the electronic device 1000 includes a processor 1010, a memory device or memory 1020, a storage device 1030, an input/output (I/O) device 1040, a power supply 1050, and an organic light-emitting diode (OLED) display 1060. Here, the electronic device 1000 may further include a plurality of ports for communicating with, for example, a video card, a sound card, a memory card, a universal serial bus (USB) device, other electronic devices, etc. One embodiment of the device of FIG. 33 includes the electronic device 1000 being implemented as a smart-phone, however, the type of the electronic device 1000 is not limited thereto.

The processor 1010 performs various computing functions. The processor 1010 may be a microprocessor, a central processing unit (CPU), etc. The processor 1010 may be connected to other components via an address bus, a control bus, a data bus, etc. Further, the processor 1010 may be connected to an extended bus such as a peripheral component interconnection (PCI) bus.

The memory device 1020 stores data for operations of the electronic device 1000. For example, the memory device 1020 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 1030 may be a solid state drive (SSD) device, a hard disk drive (HDD) device, a CD-ROM device, etc. The I/O device 1040 may be an input device such as a keyboard, a keypad, a touchpad, a touch-screen, a mouse, etc, and an output device such as a printer, a speaker, etc. The power supply 1050 may provide a power for operations of the electronic device 1000. The OLED display 1060 may communicate with other components via the buses or other communication links.

The OLED display 1060 may be the OLED display 100 of FIG. 6 or the OLED display of FIG. 32. The OLED display 1060 may be understood with reference to FIGS. 1 through 32.

The example embodiments may be applied to any electronic system 1000 having the OLED display 1060. For example, the present embodiments may be applied to an electronic system 1000, such as a digital or 3D television, a computer monitor, a home appliance, a laptop, a digital camera, a cellular phone, a smart phone, a personal digital assistant (PDA), a portable multimedia player (PMP), an MP3 player, a portable game console, a navigation system, a video phone, etc.

The described technology may be applied to the OLED display and various electronic systems having the OLED display. For example, the described technology may be applied to a mobile phone, a smart phone, a laptop computer, a tablet computer, a personal digital assistant (PDA), a portable multimedia player (PMP), a digital camera, a music player (e.g., an MP3 player), a portable game console, a navigation system, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the invention as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of digitally driving an organic light-emitting diode (OLED) display, which displays a frame by displaying a plurality of sub-frames, the frame being divided into the sub-frames, the method comprising:

calculating a first power consumption of a data driver while first data bits of first sub-frames are input to the data driver, wherein the first data bits are input to the data driver as a data signal in a data bit input order;

modifying the data bit input order; and inputting second data bits of second sub-frames to the data driver as the data signal in the modified data bit input order when the first power consumption is greater than a threshold power consumption.

2. The method of claim 1 further comprising:

inputting the second data bits to the data driver as the data signal in the data bit input order when the first power consumption is substantially equal to or less than the threshold power consumption.

3. The method of claim 1, wherein the OLED display includes a plurality of pixels and a plurality of scan lines, wherein the pixels are connected to the scan lines and wherein the frame includes a plurality of display periods and the number of the scan lines and the number of the display periods are equal.

4. The method of claim 3, wherein the first sub-frames are sub-frames of first pixels starting display in a first display period.

5. The method of claim 3, wherein the second sub-frames are sub-frames of second pixels starting display in a second display period.

6. The method of claim 1, wherein the first and second data bits are respectively input to the data driver as the data signal, which is a bit signal.

7. The method of claim 1 further comprising:

calculating a second power consumption of the data driver while the second data bits are input to the data driver as the data signal, remodifying the data bit input order until the second power consumption is substantially equal to or less than the threshold power consumption; and inputting third data bits of third sub-frames to the data driver as the data signal in the remodified data bit input order.

8. The method of claim 1, wherein the modifying comprises exchanging the input orders in the data bit input order.

9. The method of claim 1, wherein the modifying comprises reducing the number of logical value transitions of the data signal while the first data bits are input to the data driver as the data signal.

10. The method of claim 1, wherein a gray level of a pixel included in the OLED display is substantially proportional to the sum of light emitting periods applied to the pixel.

11. The method of claim 10, wherein a sub-frame having a longest light emitting period among the sub-frames corresponds to a most significant bit of the first data bits and a sub-frame having a shortest emitting period among the sub-frames corresponds to a least significant bit of the first data bits.

12. The method of claim 1, wherein the calculating is based on a current consumed by the data driver.

13. The method of claim 1, wherein the calculating is based on the number of logical value transitions of the data signal while the first data bits are input to the data driver as the data signal.

14. The method of claim 1, wherein the OLED display includes a plurality of pixels and wherein the method further comprises providing signals, generated based on the first data bits or the second data bits, to the pixels.

15. A method of digitally driving an organic light-emitting diode (OLED) display, which displays a frame by displaying a plurality of sub-frames, the frame being divided into the sub-frames, the method comprising:

calculating a first power consumption of a data driver of the OLED display while first data bits of first sub-frames are input to the data driver, wherein the first data bits are input to the data driver as a data signal in a data bit input order;

modifying the data bit input order; and inputting second data bits of second sub-frames to the data driver as the data signal in the modified data bit input order when the first power consumption is greater than a threshold power consumption, wherein the modifying comprises reducing the number of logical value transitions of the data signal while the first data bits are input to the data driver as the data signal, and wherein the modifying further comprises placing a least significant bit of the first data bits as first in the data bit input order when the least significant bit has logical value 1.

16. The method of claim 15, wherein the modifying further comprises placing data bits of the first data bits which have logical value 1 earlier in the data bit input order than data bits of the first data bits which have logical value 0.

17. A method of digitally driving an organic light-emitting diode (OLED) display, which displays a frame by displaying a plurality of sub-frames, the frame being divided into the sub-frames, the method comprising:

calculating a first power consumption of a data driver of the OLED display while first data bits of first sub-frames are input to the data driver, wherein the first data bits are input to the data driver as a data signal in a data bit input order;

modifying the data bit input order; and inputting second data bits of second sub-frames to the data driver as the data signal in the modified data bit input order when the first power consumption is greater than a threshold power consumption, wherein the modifying comprises reducing the number of logical value transitions of the data signal while the first data bits are input to the data driver as the data signal, and wherein the modifying further comprises placing a least significant bit of the first data bits as first in the data bit input order when the least significant bit has logical value 0.

18. The method of claim 17, wherein the modifying further comprises placing data bits of the first data bits which have logical value 0 earlier in the data bit input order than data bits of the first data bits which have logical value 1.

19. An organic light-emitting diode (OLED) display, comprising:

a plurality of OLEDs;

a data driver connected to the OLEDs;

a power measurement unit configured to measure the power consumed by the data driver; and a timing controller configured to:

supply a plurality of first data bits to the data driver for each OLED in a first sub-frame, wherein the first data bits are supplied to the data driver in a first order;

receive a power consumption level from the power measurement unit indicating the power consumption of the data driver in the first sub-frame;

modify the first order to a second order when the power consumption is greater than a threshold power consumption; and supply a plurality of second data bits to the data driver for each OLED in a second sub-frame, wherein the second data bits are supplied in the second order.

20. The OLED display of claim 19, further comprising a plurality of scan lines connected to the pixels, wherein each frame is divided into a plurality of sub-frames and a plurality of display periods.

* * * * *